US005090678A

United States Patent [19]

Green

[11] Patent Number: 5,090,678

[45] Date of Patent: Feb. 25, 1992

[54] METHOD AND APPARATUS OF FORMING A SEPARATED STACK OF ZIGZAG FOLDED SHEETS FROM A MAIN STACK

[75] Inventor: Robert L. Green, Hillsboro, Ohio

[73] Assignee: G. Fordyce Co., Hillsboro, Ohio

[21] Appl. No.: 705,028

[22] Filed: May 17, 1991

[51] Int. Cl.[5] ..... B61H 41/00

[52] U.S. Cl. ..... 270/52.5; 270/39; 493/357; 493/410; 225/103

[58] Field of Search ..... 270/31, 39, 40, 52, 270/52.5; 493/356–511, 410–415; 225/93, 104, 103

[56] References Cited

U.S. PATENT DOCUMENTS

| | | | |
|---|---|---|---|
| 2,675,747 | 4/1954 | Greiner | 493/410 |
| 2,761,677 | 9/1956 | Rutkus | 270/39 |
| 3,301,111 | 1/1967 | Nystrand | 83/92 |
| 3,784,188 | 1/1974 | De Ligt . | |
| 3,858,476 | 1/1975 | De Ligt | 83/512 |
| 4,054,283 | 10/1977 | Rayfield . | |
| 4,396,336 | 8/1983 | Malamood | 414/115 |
| 4,406,650 | 9/1983 | Felix | 493/410 |
| 4,408,755 | 10/1983 | Meier | 270/52 |
| 4,507,109 | 3/1985 | Meschi | 493/356 |
| 4,508,527 | 4/1985 | Uno | 493/357 |
| 4,618,340 | 10/1986 | Meschi | 493/13 |
| 4,650,447 | 3/1987 | Meschi | 493/11 |
| 4,673,382 | 6/1987 | Buck | 493/359 |
| 4,700,939 | 10/1987 | Hathaway | 270/39 |
| 4,702,135 | 10/1987 | Kwasnita | 83/278 |
| 4,708,332 | 11/1987 | Besemann | 270/39 |
| 4,717,135 | 1/1988 | Hathaway | 270/39 |
| 4,718,654 | 1/1988 | Ehlers | 270/52.5 |
| 4,721,295 | 1/1988 | Hathaway | 270/52.5 |
| 4,747,591 | 5/1988 | Beyer | 270/525 |
| 4,750,724 | 6/1988 | Herd | 270/39 |
| 4,770,402 | 9/1988 | Couturier | 270/39 |
| 4,778,165 | 10/1988 | Buck | 270/39 |
| 4,842,572 | 6/1989 | Roth | 493/357 |
| 4,842,573 | 6/1989 | Peter | 493/412 |
| 4,846,454 | 7/1989 | Parkander | 270/5 |
| 4,871,157 | 10/1989 | Hermann | 270/39 |
| 4,908,010 | 3/1990 | Yoshioka | 493/357 |
| 4,917,365 | 4/1990 | Stemmer | 270/52.5 |

*Primary Examiner*—Edward K. Look
*Assistant Examiner*—Therese M. Newholm
*Attorney, Agent, or Firm*—Wood, Herron & Evans

[57] ABSTRACT

A method and apparatus for forming separated stacks of perforated, zigzag folded sheets from a main stack comprises a feed conveyor adapted to receive the folded sheets and to transmit such sheets on their folded ends to a sheet spreading and cutting station. Two adajcent sheets of the main stack are spread apart at the spreading and cutting station by a divider plate and a separator blade to provide sufficient clearance for a flexible cutter to extend into engagement with the perforation therebetween thus forming a relatively small, separated stack of folded sheets from the main stack. This separated stack is then transferred to a discharge conveyor for further handling.

29 Claims, 11 Drawing Sheets

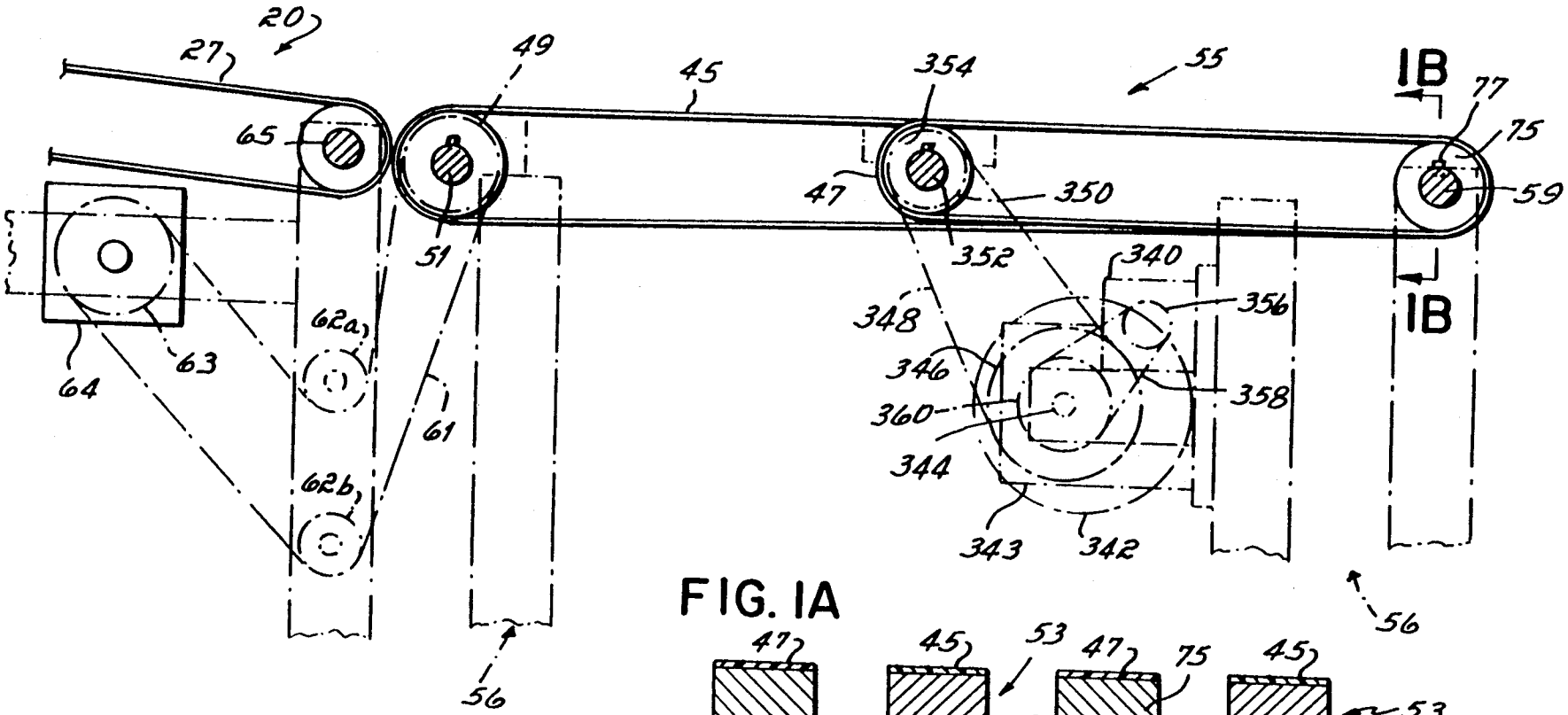
FIG. IA
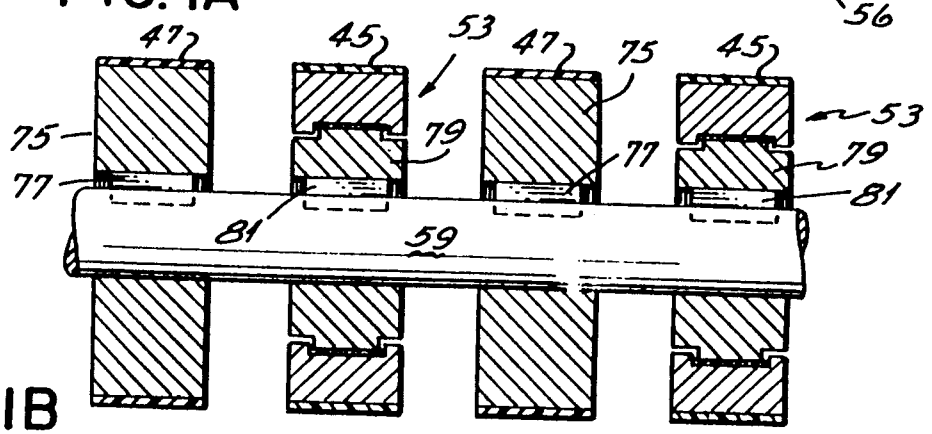
FIG. IB

METHOD AND APPARATUS OF FORMING A SEPARATED STACK OF ZIGZAG FOLDED SHEETS FROM A MAIN STACK

FIELD OF THE INVENTION

This invention relates to stack separating devices, and, more particularly, to a method and apparatus for forming separated stacks of zigzag folded sheets, which are interconnected at adjacent, folded ends by perforations, from a main stack of sheets discharged from a zigzag folding machine.

BACKGROUND OF THE INVENTION

High speed printing machines have been developed in recent years for printing data on computer paper, business forms and the like. The paper supplied to such printers is provided in webs of indeterminate length formed with longitudinally spaced, transversely oriented perforations. The paper is fed at high speeds from the web to the printer which prints the desired information on the individual sheets formed between adjacent perforations, and then discharges the printed sheets for further handling.

In order to convert the continuous length of paper from the printer into a form which can be handled and shipped, the paper first must be folded along its perforations after it is discharged from the printer. One type of folding apparatus intended for use with high speed printers is a spiral, zigzag folder of the type disclosed in U.S. Pat. No. 4,828,540, which is owned by the assignee of this invention. Spiral zigzag folders crease the continuous length of paper at the longitudinally spaced perforations to form folded sheets which are interconnected at the perforations. Because the webs which supply paper to the printers and zigzag folders are of indeterminate length, an essentially continuous stack of printed, zigzag folded sheets is discharged from the zigzag folder in the course of a production run. A separating device therefore must be provided to cut or separate the continuous main stack of folded sheets at selected intervals to form smaller, separated stacks of folded sheets which can be boxed for handling and shipment.

A number of stack separating devices have been developed for this purpose, and representative devices are disclosed, for example, in U.S. Pat. Nos. 4,618,340; 4,396,336; 4,778,165; 4,718,654; 4,750,724; and, 4,508,527. Stack separating devices of the type disclosed in these patents are either associated with a particular folding machine, or are separate and located downstream from the folder. In either type of separating device, the folded sheets are discharged from the folder onto a horizontally oriented support plate which is movable vertically downwardly as successive folded sheets are discharged from the zigzag folder. At selected intervals, when a sufficient number of sheets have accumulated on the horizontal support plate, a separator plate is extended between two adjacent sheets of the stack so that a downstream portion of the stack is formed which is located between the separator plate and the horizontal support plate, and a main, upstream stack is formed which is located between the separator plate and the folder. A cutter mechanism associated with the separator plate, or, alternatively a separate cutter mechanism, is then actuated to break the perforation between the two adjacent sheets spread apart by the separator plate. After separation, the downstream, separated stack is moved by the horizontal support to a take away location during which time the separator plate remains in place to support the main stack of folded sheets accumulating between the separator plate and folder. After the horizontal support plate has removed the separated stack of folded sheets, it returns to an initial position beneath the main stack of folded sheets thus allowing the separator plate to be withdrawn in preparation for another separation operation.

One problem with separating devices of the type described above is that separation of two adjacent sheets within a growing, vertical stack of folded sheets can be a difficult operation. If the folder is operated at relatively high speed, the stack of folded sheets grows rapidly in height and weight. The separator plate must be advanced in a horizontal direction between two adjacent sheets of this vertically growing stack without displacing the stack in a horizontal direction as it moves into the stack. Additionally, the separator plate must overcome the weight of the folded sheets located above it without ripping or tearing the sheets upon entering the stack. Each of these problems can produce ripping or tearing of the folded sheets and/or displacement of the vertically oriented stack in the course of a cutting operation. These problems can result in requiring operation of the folder at slower speeds, so that the rate of formation of the vertically oriented stack is reduced.

Another type of stack separating device which has been proposed as an alternative to that described above is disclosed, for example, in U.S. Pat. Nos. 4,747,591 and 4,507,109. In these stack separating devices, the folded sheets are discharged from a zigzag or other type of folder onto a conveyor which transmits the sheets on their folded ends, e.g., horizontally, instead of in a vertically oriented stack. A cutter mechanism is provided downstream from the folder which separates two adjacent sheets within the horizontally oriented stack, cuts or breaks the perforation between such sheets and then conveys the separated stack of sheets to a location for further handling. While devices of this type solve some of the problems associated with the separation of vertically oriented stacks, other problems are nevertheless created. For example, neither of the devices disclosed in U.S. Pat. Nos. 4,747,591 and 4,507,109 provide for adequate displacement of the adjacent sheets to be separated so that the cutting or separating operation can proceed without tearing of either sheet.

SUMMARY OF THE INVENTION

It is therefore among the objectives of this invention to provide a method and apparatus for forming separated stacks of folded sheets from a main stack, which is capable of operating at high speeds and which produces a clean, reliable separation between adjacent sheets of the main stack.

These objectives are accomplished in a method and apparatus according to this invention which comprises a feed conveyor adapted to receive folded sheets interconnected by perforations and to transmit such sheets on their folded ends to a sheet spreading and cutting station. Two adjacent sheets of the main stack are spread apart at the spreading and cutting station to provide sufficient clearance for a flexible cutter to extend into engagement with the perforation therebetween thus forming a relatively small, separated stack of folded sheets from the main stack. This separated stack is then transferred to a discharge conveyor for further handling.

An important aspect of this invention is the provision of devices at the spreading and cutting station which positively contact each of the two adjacent sheets where the stack separation is to take place, i.e., the first sheet of the main stack of folded sheets discharged from the folder, and the last sheet of the smaller stack of folded sheets to be separated from the main stack. In the presently preferred embodiment, an upstream, divider plate is extended between such adjacent, folded sheets and then driven in an upstream direction against the first sheet of the main stack to restrain the main stack from further downstream movement with the feed conveyor and to produce at least an initial gap or clearance between the two adjacent sheets. In timed sequence, a downstream separator blade is extended into engagement with the last sheet of the separated stack to force the separated stack downstream to some extent. The upstream divider plate and downstream separator blade form a gap between the adjacent first and last sheets which provides sufficient clearance for a flexible cutter to be extended into a position to cut or break the perforation between such adjacent sheets. Because the first and last sheets of the respective stacks are each positively contacted and forced apart, the cutting operation is performed efficiently and with minimal chance of ripping or tearing the sheets.

After the perforation between the adjacent first and last sheets has been cut or broken, a take away conveyor and stack removal mechanism are activated to transfer the separated stack to a discharge conveyor for further handling. During at least a portion of this stack take away operation, the upstream divider plate, flexible cutter and downstream separator blade all remain in their extended positions to restrain downstream movement of the main stack of folded sheets. Such elements are then retracted, allowing the main stack to resume its downstream movement to the stack spreading and cutting mechanism in preparation for another stack separation operation.

DESCRIPTION OF THE DRAWINGS

The structure, operation and advantages of the presently preferred embodiment of this invention will become further apparent upon consideration of the following description, taken in conjunction with the accompanying drawings, wherein:

FIG. 1A is a schematic, side view of a portion of the main feed conveyor and take off conveyor;

FIG. 1B is a cross sectional view taken generally along line 1B—1B of FIG. 1A;

DETAILED DESCRIPTION OF THE INVENTION

Figure 1:
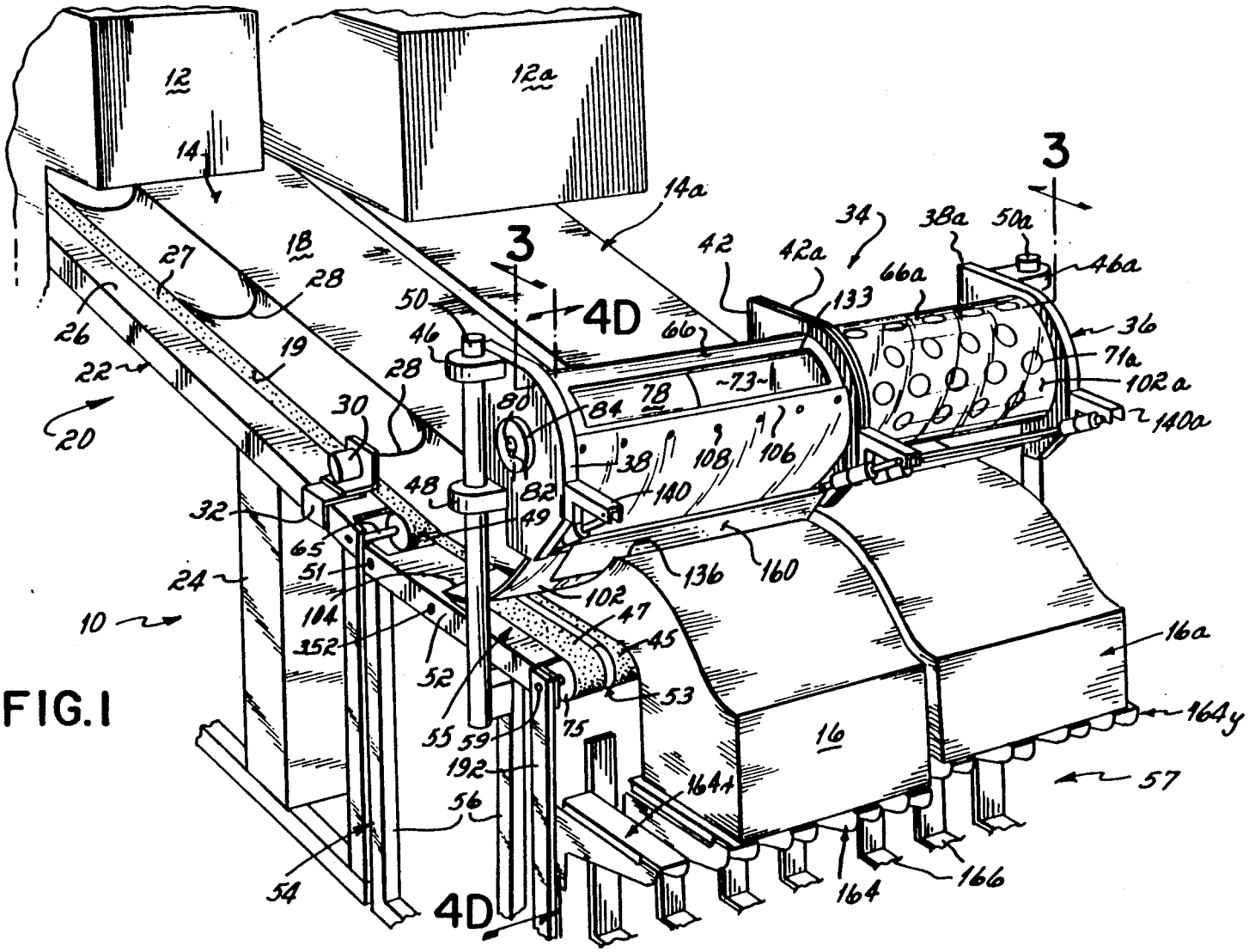
FIG. 1 is a partial perspective view of the stack separating apparatus of this invention.

Referring now to the FIGS., the stack separator apparatus 10 of this invention as viewed in FIG. 1 is adapted for use with high speed zigzag folding devices of the type described in U.S. Pat. No. 4,828,540, owned by the assignee of this invention, the disclosure of which is incorporated by reference in its entirety herein. As described in Pat. No. 4,828,540, a paper web of indeterminate length formed with longitudinally spaced, transversely oriented perforations is printed with the desired information in a high speed printer and is then transferred to two zigzag folders 12 and 12*a* which are schematically depicted in FIG. 1. For purposes of the present discussion, the apparatus 10 is illustrated in combination with two zigzag folders 12, 12*a*, each of which folds a web of paper along its perforations to produce a separate, main stack 14 and 14*a*, respectively. It should be understood that the apparatus 10 is capable of handling one, two or three separate stacks, and the particular embodiment shown in the FIGS. is provided for illustration.

The stack separator apparatus 10 functions to form separated stacks 16 and 16*a* from the main stacks 14, 14*a*, respectively, and to convey these separated stacks 16, 16*a* to a location for further handling such as packaging and the like. Each of the components of apparatus 10 is described separately below, and then the combined operation of apparatus 10 is discussed.

Feed Conveyor

With reference to FIG. 1, in the presently preferred embodiment, the two zigzag folders 12, 12*a* are positioned side-by-side to discharge separate main stacks 14, 14*a* of folded sheets 18 onto a feed conveyor 20. The feed conveyor 20 includes a frame 22 having upright support columns 24 which mount a downwardly angled top plate 26 carrying one or more endless belts 27. The folded sheets 18 are transmitted by the feed conveyor 20 on their folded edges 19 in a "downstream" direction, i.e., to the right as viewed in FIG. 1. Because of the weight of the folded sheets 18, and the angulation of the top plate 26 of frame 22, the folded sheets 18 do not assume a perfectly vertical orientation, but are bowed or curved in a convexly arcuate shape in the downstream direction.

Each of the zigzag folders 12, 12*a* is equipped with a marking device (not shown) which applies a darkened stack division line 28 at longitudinally spaced locations along one edge of each main stack 14, 14*a*. These stack division lines 28 are sensed by an optical scanner 30 which is mounted to the top plate 26 of frame 22 by a bracket 32. The optical scanner 30 functions to sense a stack division line 28 as it passes by, and then activate the stack spreading and cutting mechanism of the stack separator 10 as described in detail below.

Stack Spreading and Cutting Mechanism

Referring now to FIGS. 1 and 3–4D, the stack spreading and cutting mechanism 34 of apparatus 10 is illustrated. As mentioned above, in the particular embodiment of apparatus 10 illustrated in the FIGS., two zigzag folders 12, 12a produce two main stacks 14, 14a of folded sheets 18 each of which is divided into a separated stack 16, 16a by the separator and cutting mechanism 34. The structure of mechanism 34 which performs the stack spreading and cutting operation on each main stack 14 and 14a is structurally and functionally identical. The following discussion is directed to one side of the mechanism 34 associated with main stack 14, and the structure of mechanism 34 which is associated with main stack 14a is identified with the same reference numbers with the addition of the letter "a".

Figure 3:
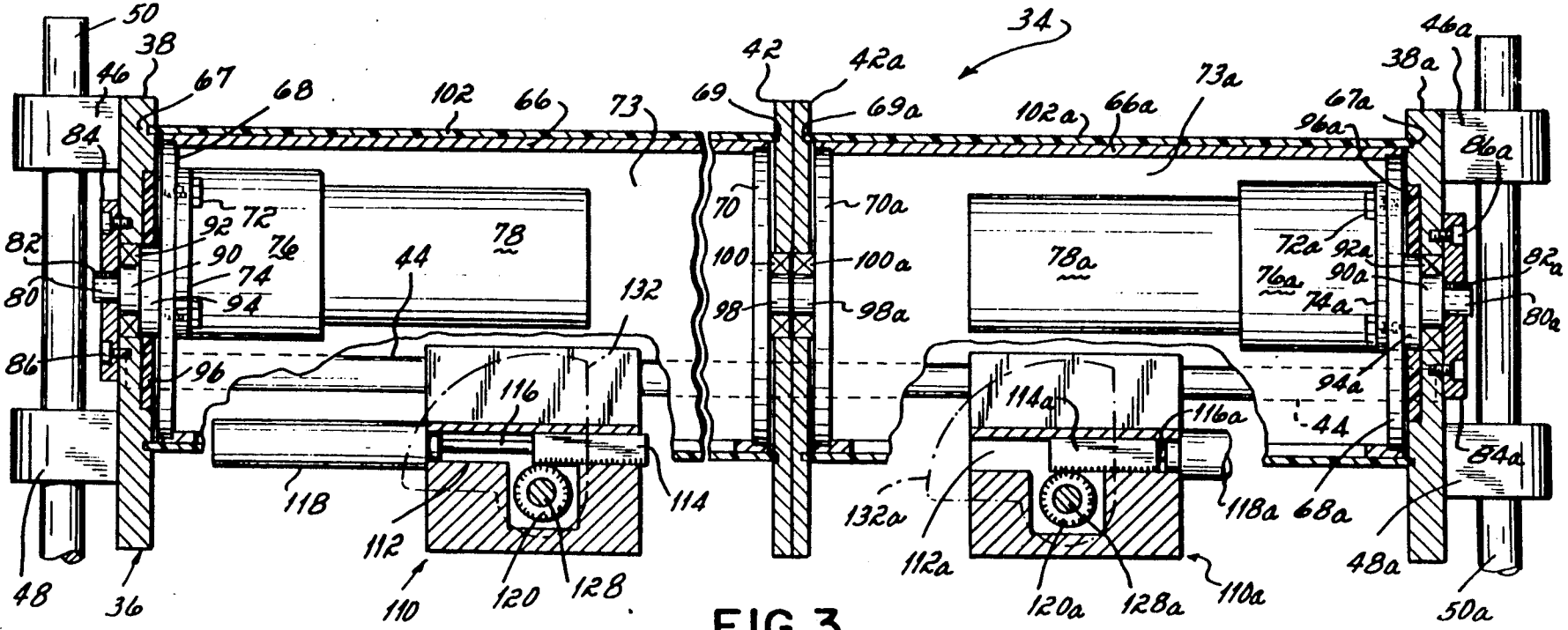
FIG. 3 is a cross sectional view of the stack spreading and cutting mechanism taken generally along line 3—3 of FIG. 1.

With reference to the left side of FIGS. 1 and 3, the portion of stack spreading and cutting mechanism 34 associated with main stack 14 comprises a side plate 38 and a center plate 42 interconnected by a rod 44 which extends to the side plate 38a on the right hand side of mechanism 34. The side plate 38 has a pair of brackets 46, 48 which mount a support post 50 fixedly attached to a take off conveyor frame 54. The frame 54 mounts a top plate 52 which is supported by vertical legs 56 and carries a take-off conveyor 55 described in more detail below. As shown in FIGS. 1 and 3, the two posts 50, 50a mount the spreading and cutting mechanism 34 above the main stack 14, 14a and take-off conveyor 55, in position between the feed conveyor 20 and the stack take-away mechanism 57 described in detail below.

With reference to FIGS. 1, 1A and 1B, the take off conveyor 55 includes a number of alternating long belts 45 and short belts 47 located downstream from the main feed conveyor 20. Each long belt 45 extends between an upstream pulley 49 keyed to an upstream shaft 51, and a downstream slip pulley assembly 53 keyed to a downstream shaft 59. The upstream shaft 51 also mounts a sprocket 60 connected by an endless chain 61 through a pair of idler rollers 62a, b to a sprocket 63 mounted at the output of a gear reducer 64. The main feed conveyor 20 and gear reducer 64 are each driven by the folder 12 at the same rate so that the upstream shaft 51, in turn, is driven at the same rate as a downstream shaft 65 associated with the main feed conveyor 20 which carries belt 27.

As viewed in FIGS. 1A and 1B, each of the short belts 47 are carried by pulleys 75 keyed to the downstream shaft 59, and also extend around an intermediate pulley 75 carried on shaft 352 as described below in connection with a discussion of a stack take off operation. Each of the pulleys 75 which carry the short belts 47 are fixed by a key 77 to the downstream shaft 59. The downstream pulley assemblies 53 which carry long belts 45, however, are provided with a roller clutch mechanism 79. The clutch mechanism 79, of slip pulley assembly 53, is keyed to shaft 59 by a key 81 for continuous rotation with the shaft. This conventional construction is illustrated schematically in FIG. 1B, to permit slippage of the long belts 45 with respect to the downstream shaft 59 for purposes to become apparent below.

Figure 4:
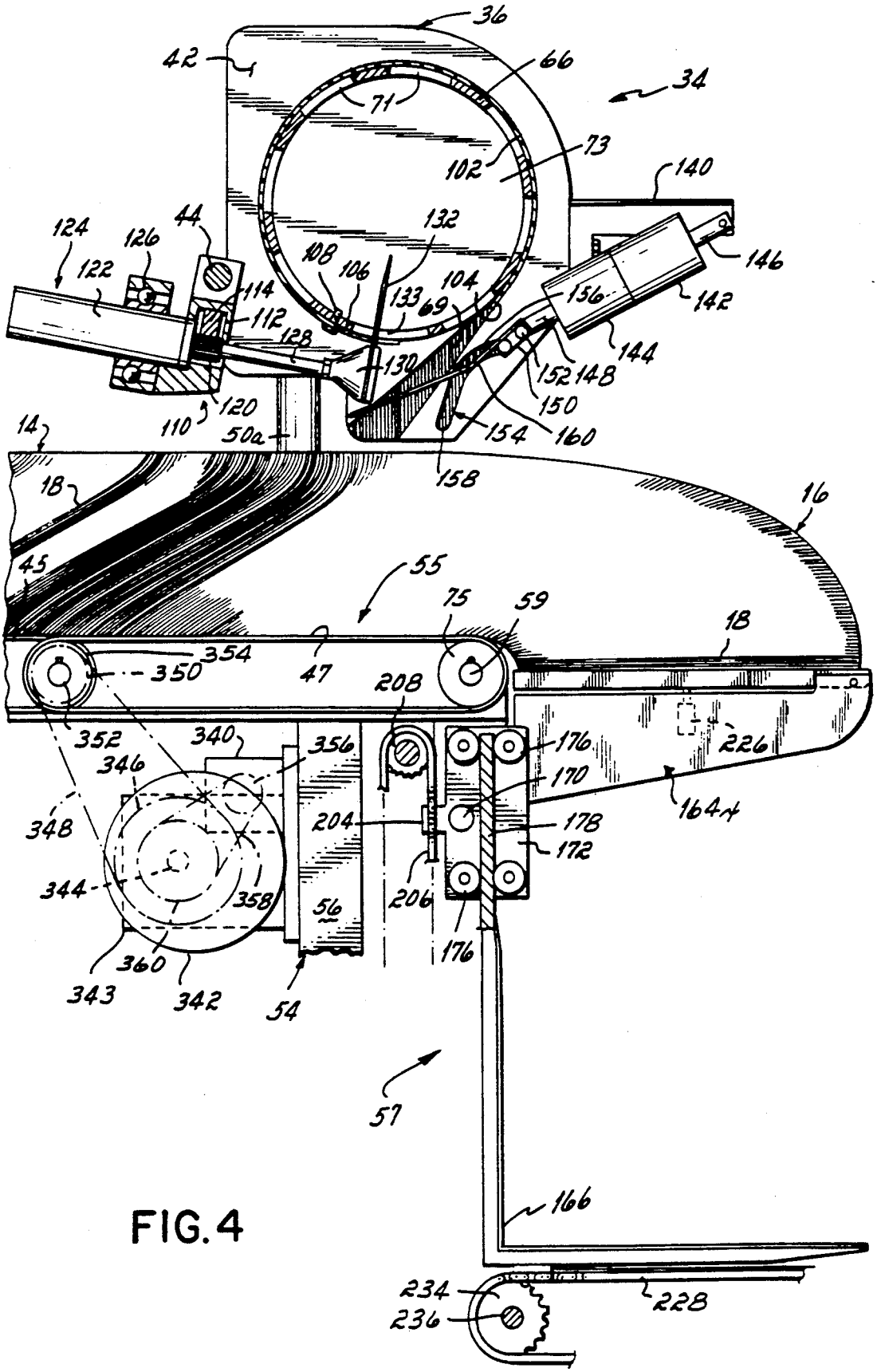
FIG. 4 is an enlarged, side elevational view, in partial cross section, of the stack spreading and cutting mechanism and a portion of the stack removal mechanism.
Figure 4A:
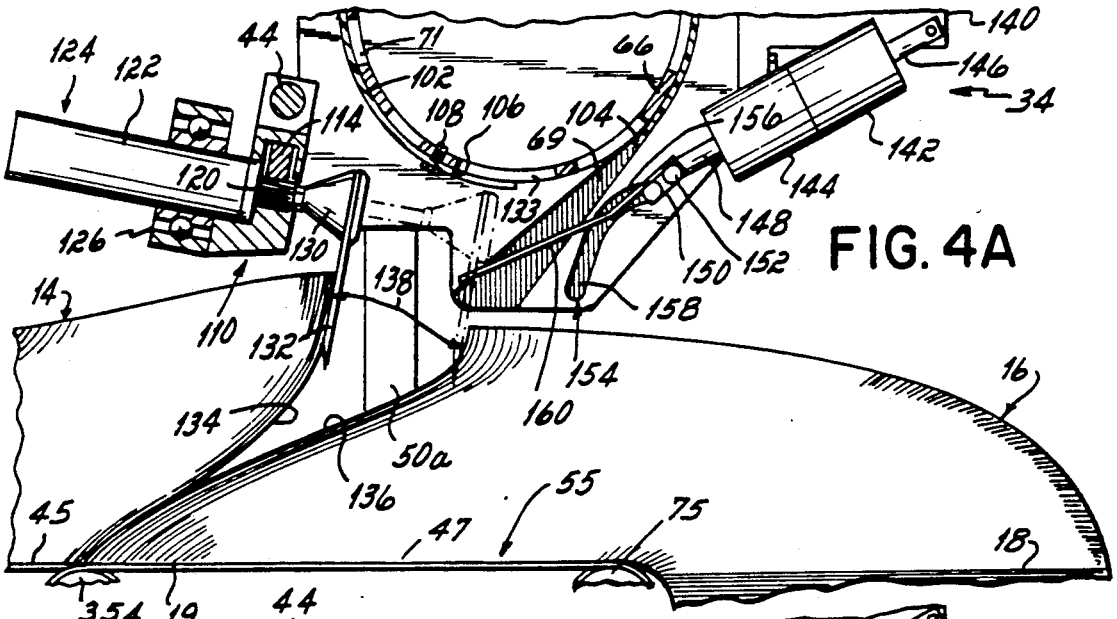
FIGS. 4A–4D are side elevational views, in partial cross section, illustrating the sequence of a stack spreading and cutting operation.

Referring now to FIGS. 3 and 4, the detailed construction of the lefthand portion of stack spreading and cutting mechanism 34 associated with main stack 14, is illustrated. This portion of the stack spreading and cutting mechanism 34 includes a hollow cylinder 66 having opposed end caps 68 and 70, and a number of bores or apertures 71 for cooling of the cylinder interior 73. The cylinder 66 is rotatably mounted in slots 67 and 69 formed in the side plates 38, 42, respectively. End cap 68 is fixedly connected by bolts 72 to a mounting plate 74 which carries a gear reducer 76 within the interior 73 of cylinder 66. The gear reducer 76 is drivingly connected to a reversible motor 78. The output shaft 80 of gear reducer 76 is fixed by a key 82 to a plate 84 connected by screws 86 to the side plate 38. This output shaft 80 is stepped having an internal diameter portion 90 mounted in a bearing 92 in the first side plate 38, and a larger diameter portion 94 electrically connected by brush contacts (not shown) to an electrical contact plate 96 mounted in a recess formed in the fixed side plate 38. As viewed in the middle of FIG. 3, the opposite side of cylinder 66 carrying end cap 70 is rotatably mounted to the center plate 42 by a stub shaft 98 which is fixed at one end to the end cap 70 and is carried in a bearing 100 mounted in the center support plate 42.

As described in more detail below in connection with a discussion of the operation of apparatus 10, the reversible motor 78 and gear reducer 76 operate to rotate the cylinder 66 within slots 69, 71 in a clockwise and then counterclockwise direction to effect a cutting operation. Because the output shaft 80 of gear reducer 76 is mounted to the fixed side plate 38, and the housing of gear reducer 76 is mounted to the end plate 68 of cylinder 66, the gear reducer 76 and reversible motor 78 rotate with the cylinder 66 relative to the side plate 38 and support plate 42.

Figure 4B:
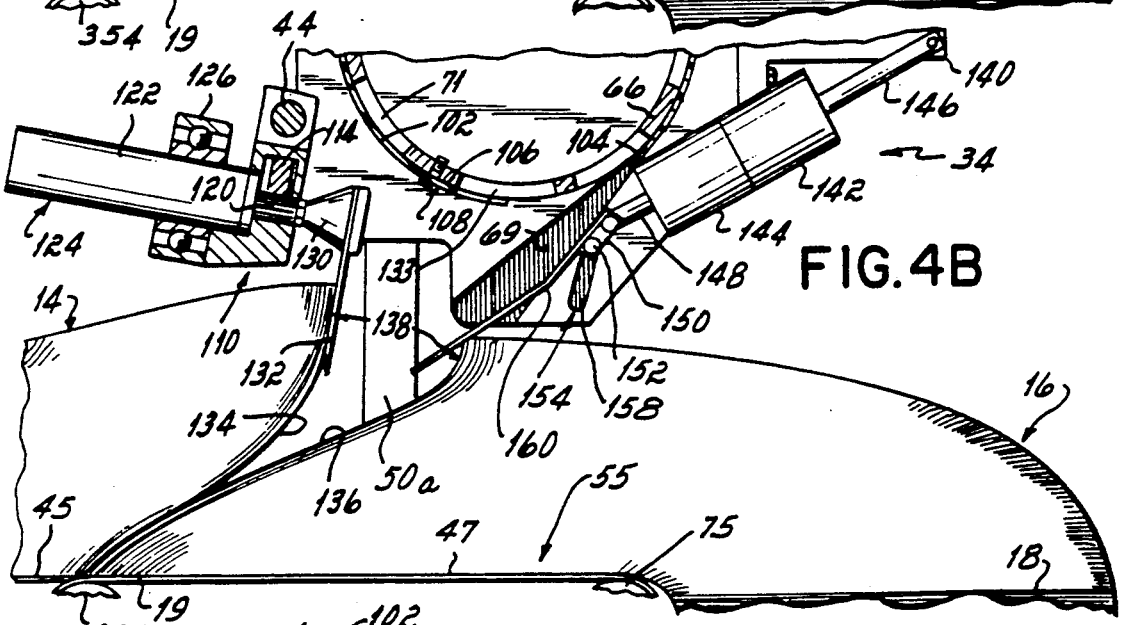
Figure 4C:
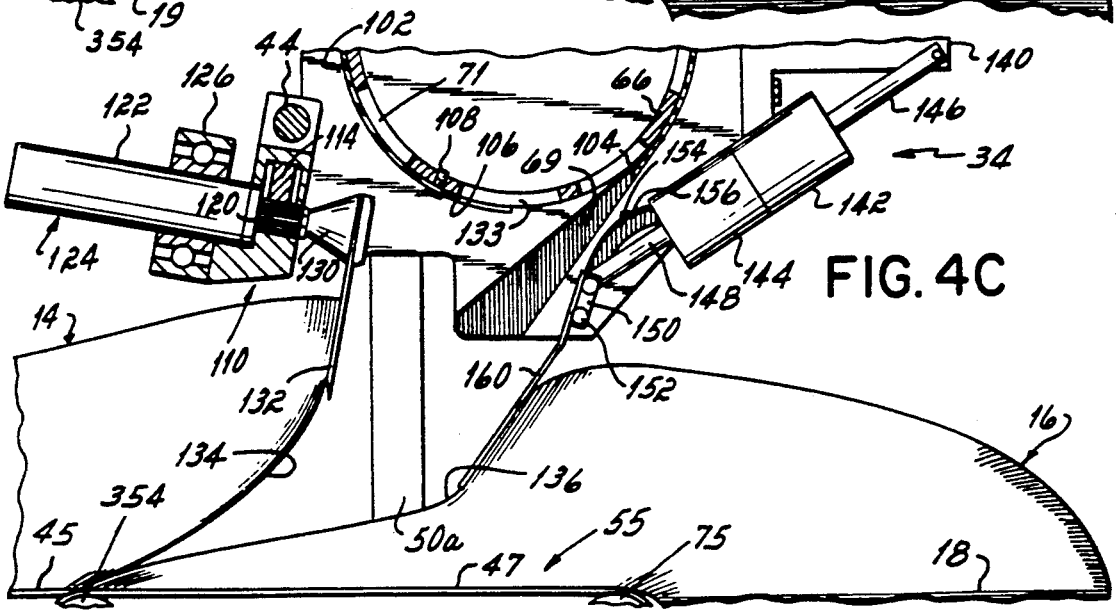
Figure 4D:
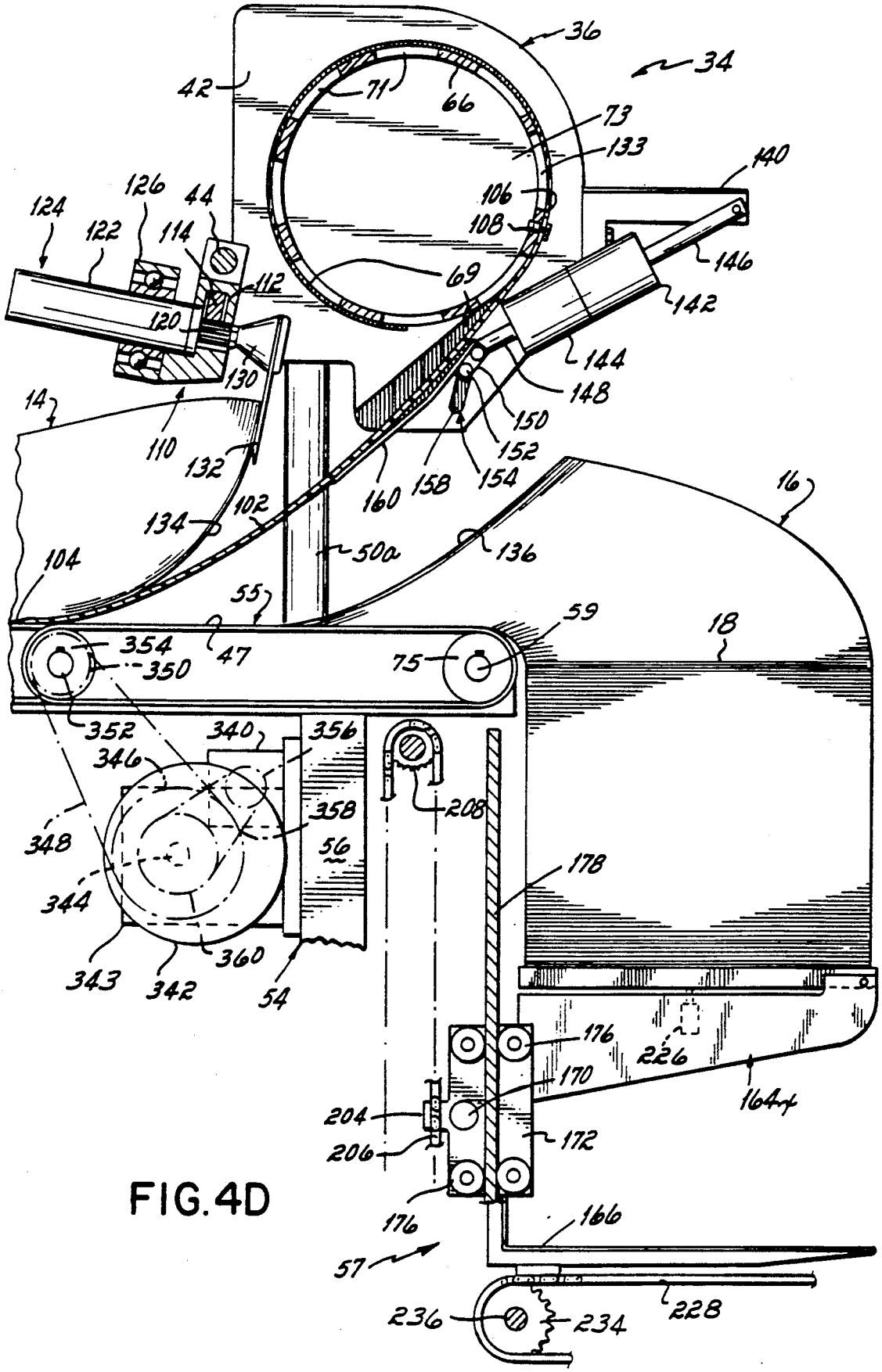

In the presently preferred embodiment, a flexible cutter 102 is carried on the exterior surface of cylinder 66 and is movable in response to rotation of cylinder 66 between a retracted position in which the cutter 102 is wrapped around the cylinder 66 (FIG. 4), and an extended position in which the cutter 102 is unwrapped from cylinder 66 (FIG. 4D). The flexible cutter 102 is preferably a sheet of clear polycarbonate material, such as that commercially available under the trademark "Lexan", or some other type of flexible, durable material. The cutter 102 is formed with a leading, cutting edge 104 and a trailing end 106 fixedly connected by screws 108 to the cylinder 66. In the presently preferred embodiment, the flexible cutter 102 is formed to assume the shape of the outer surface of cylinder 66, but, when moved to an extended, cutting position, the flexible cutter 102 generally conforms to the bowed, convexly arcuate shape of the folded sheets 18 of main stack 14, as described below in connection with a discussion of the operation of apparatus 10.

An important aspect of this invention is the provision of structure to ensure that the flexible cutter 102 can perform a cutting operation to separate adjacent folded sheets 18 of main stack 14 without tearing or otherwise damaging such sheets 18. This is accomplished in the presently preferred embodiment of the apparatus 10 herein by positively engaging and spreading adjacent sheets to provide sufficient clearance for the flexible cutter 102. The structure of stack spreading and cutting mechanism 34 which performs this spreading function is illustrated in FIGS. 3–4D.

In the presently preferred embodiment, the rod 44 mounts a cylinder and gear rack housing 110. Housing 110 is formed with a stepped throughbore 112 which receives a rack 114 mounted at one end of the cylinder rod 116 of a pneumatic cylinder 118 carried by the housing 110. The rack 114 is drivingly engageable with a pinion gear 120 which is fixed to the cylinder housing 122 of a second pneumatic cylinder 124. This second pneumatic cylinder 124 is rotatably mounted within a bearing 126 fixed to the cylinder and gear rack housing 110. The cylinder rod 128 of second cylinder 124 extends through the hollow pinion gear 120 and supports a divider mount 130 at its outermost end which is fixedly connected to an upstream, divider plate 132.

The divider plate 132 is rotatable between a retracted position shown in FIG. 4 wherein it extends through a slot 133 into the interior of cylinder 66, and a sheet dividing or spreading position shown in FIGS. 4–4D. In response to activation of the first cylinder 118, the rack 114 is moved to rotate pinion gear 120, which, in turn, causes the second cylinder 124, cylinder rod 128 and divider mount 130 to rotate. Rotation of the second cylinder 124 is permitted because it is mounted within the bearing 126. The divider plate 132 is rotated by divider mount 130 downwardly as viewed in the FIGS. 4–4D to a sheet separation position in which the divider plate 132 initially separates two adjacent, folded sheets 18 of the main stack 14. As viewed in FIGS. 4A–4D, initial separation of the main stack 14 forms a first sheet 134 of the main stack 14 which is contacted by divider plate 132, and a last sheet 136 of the separated stack 16. The term "first sheet" 134 is used to refer to the first downstream sheet of main stack 14 after separation of the separated stack 16 from the main stack 14. The term "last sheet" 136 is used to refer to the sheet immediately downstream from the divider plate 132 which is the furthest upstream or "last" sheet within the separated stack 16 after the cutting operation described below is completed.

In addition to initially extending between two adjacent sheets 18 of main stack 14, the divider plate 132 assists in creating a gap or clearance 138 between the first and last sheets 134, 136 to facilitate the cutting operation described below. See FIGS. 4A and 4B. In the presently preferred embodiment, the divider plate 132 is moved in an upstream direction by retraction of the cylinder rod 128 of second cylinder 124 from an initial position shown in phantom at which the divider plate 132 first extends between the first and last sheets 134, 136, and an upstream or stack retraction position shown in solid lines in FIG. 4A. In the stack retraction position, the divider plate 132 restrains further downstream movement thereof in preparation for the cutting operation, as described below.

The clearance 138 between the first and last sheets 134, 136, initially formed by operation of the divider plate 132 described above, is enlarged by the operation of a second sheet separating device associated with the stack spreading and cutting mechanism 34. Referring to the righthand portion of FIGS. 4–4D, the side plate 38 and center support plate 42 of frame 36 each mount a bracket 140 which carries a pair of pneumatic cylinders 142 and 144 mounted back-to-back. The cylinder rod 146 of cylinder 142 is pinned to the bracket 140, and the cylinder rod 148 of pneumatic cylinder 144 is connected to a carriage 150 having a pair of rollers 152. The rollers 152 are movable within an arcuate slot 154 formed in the side plate 38 and in the outer support plate 42. This arcuate slot 154 has an upper portion 156 which extends generally in an upstream direction, and a lower portion 158 which extends generally downwardly toward the take off conveyor 55. The carriage 150 mounts a downstream separator blade 160 which is essentially a solid plate with optionally one or more cut-outs formed therein.

In the presently preferred embodiment, the downstream separator blade 160 undergoes a two-stage movement with respect to the last sheet 136 of separated stack 16 to (1) assist in the formation of a larger clearance 138 between the first and last sheets 134, 136, and (2) to help support the flexible cutter 102 in its extended cutting position. The first stage of the movement of separator blade 160 is produced by operation of cylinder 142 as shown in FIG. 4B wherein its cylinder rod 146 is extended thus forcing both of the pneumatic cylinders 142, 144 downwardly with respect to the mounting bracket 140. In turn, the rollers 152 of carriage 150 move along the upper portion 156 of arcuate slot 154 so that the separator blade 160 is moved in an angled, generally upstream direction with respect to the last sheet 136 of separated stack 16. The second stage motion of separator blade 160 is provided by actuating cylinder 144 to extend its cylinder rod 148. The cylinder rod 148 moves carriage 150 within the lower portion 158 of arcuate slot 154 which, in turn, moves the separator blade 160 in a generally downstream direction and into contact with the last sheet 136 of separated stack 16 to provide a relatively wide clearance 138 between the last sheet 136 and first sheet 134. See FIG. 4C.

After the divider plate 132 and separator blade 160 form the large clearance 138 between the first and last sheets 134, 136, the flexible cutter 102 is extended by rotation of cylinder 66 in the manner described above so that its leading, cutting edge 104 contacts and breaks or cuts the perforations between such sheets 134, 136, as described more fully below. With the sheets 134, 136 separated, the cylinder 144 is operated to retract its cylinder rod 148 causing the rollers 152 of carriage 150 to move upwardly along the lower portion 158 of arcuate slot 154. This positions the separator blade 160 against the lower surface of the flexible cutter 102, as viewed in FIG. 4D, to help support the flexible cutter 102 against the main stack 14 of folded sheet 16 as the separated stack 16 is conveyed to a discharge position in the manner described below. After completion of the cutting operation and take away of the separated stack 16, the divider plate 132, flexible cutter 102 and separator blade 160 are all returned to their initial positions (FIG. 4) in preparation for another stack separation operation.

Take Away and Discharge of Separated Stack

Referring now to FIGS. 2, 4 and 5–8, structure 57 is illustrated for receiving the separated stacks 16 and **16*a* from the take off conveyor 55 and discharging them onto a discharge conveyor 162 for further handling, such as the placement of the separated stacks 16, 16*a* into boxes for shipment. Each separated stack 16, 16*a* is transmitted vertically downwardly from the take off conveyor 55 to a position at which the separated stacks 16, 16*a* are transferred horizontally to the discharge conveyor 162**.

Because two zigzag folders 12 are employed upstream from the stack separator apparatus 10, thus forming two sets of main stacks **14, 14*a* and two sets of separated stacks 16, 16*a*, the apparatus 10 must be provided with a stack take away mechanism for each separated stack 16 and 16*a*. For ease of description, only one of the stack take away mechanisms 57 is described herein, i.e., for the separated stack 16, it being understood that identical structure is provided for the separated stack 16*a***. This structure is given the same reference numbers in the FIGS., with the addition of the letter "a".

Vertical Transfer of Separated Stack

As viewed in FIGS. 2, 4 and 5–8, the folded sheets 18 from the zigzag folder 12 are transmitted by the take off conveyor 55 beneath the stack spreading and cutting mechanism 34 and onto a number of laterally spaced, stack support arms 164 located at the discharge end of the take off conveyor 55. These stack support arms 164 are interleaved with a number of L-shaped pusher blades 166, the structure and purpose of which is described below. The stack support arms 164 are each fixedly mounted by a yoke 168 to a mounting rod 170 which is fixed at one end to an outermost carriage 172 and at the opposite end to a carriage 174 located at the center of a support frame 182 which carries both of the stack take-away mechanisms 57, 57*a*. As viewed in FIGS. 2 and 5, the support frame 182 includes opposed upper, longitudinal frame members 183, 183*a* connected by intermediate and end horizontal cross members 184 and opposed lower, longitudinal frame members 185, 185*a* connected by second cross members 186. The upper and lower frame members 183, 185 on one side of support frame 182 are connected by upright supports 188, and the upper and lower frame members 183*a*, 185*a* on the opposite side of support frame 182 are connected by upright supports 188*a*.

Figure 2:
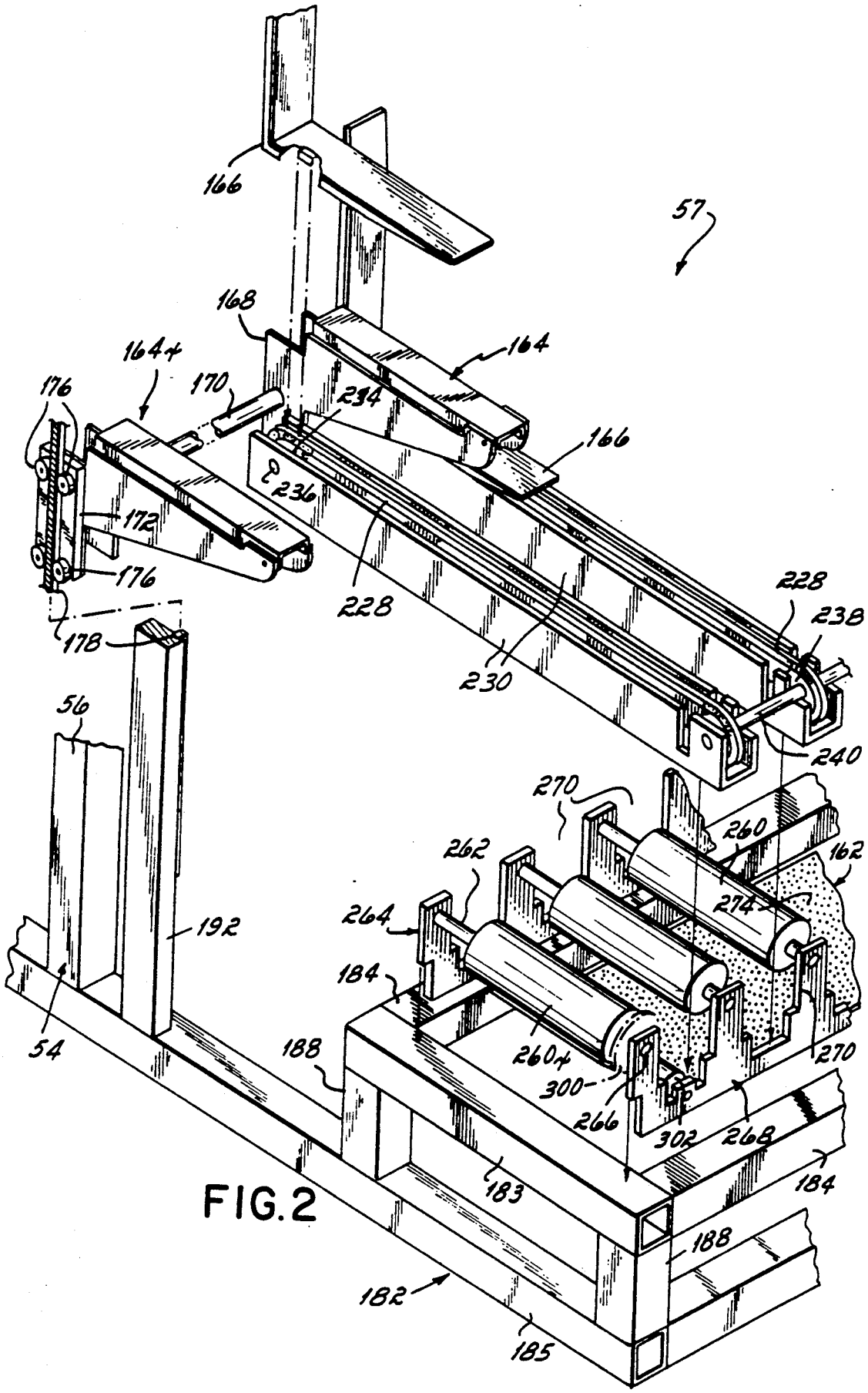
FIG. 2 is a diagrammatic disassembled perspective view of a portion of the stack removal mechanism herein.
Figure 8:
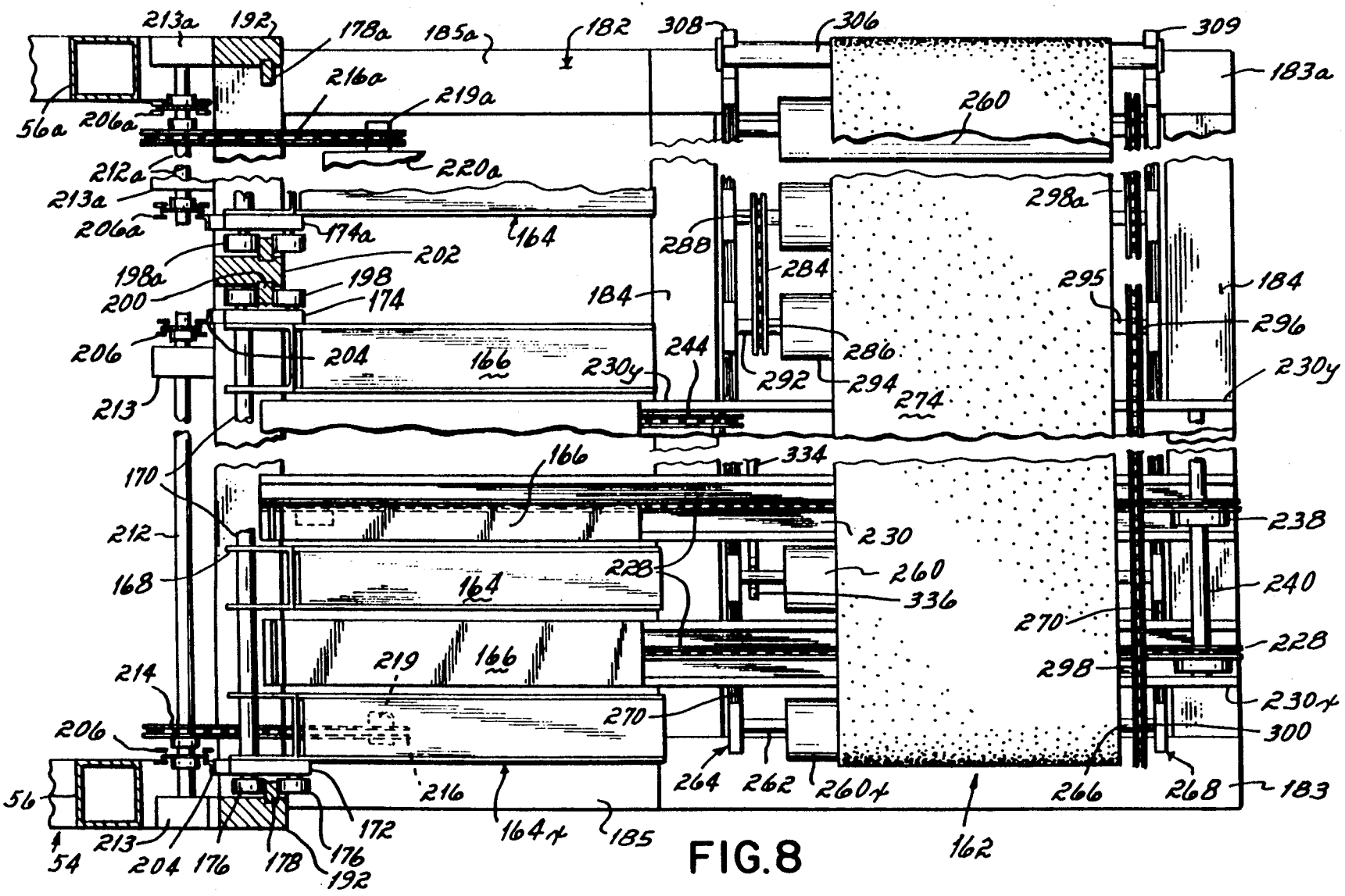
FIG. 8 is a plan view of the stack removal mechanism taken generally along lines 8—8 of FIG. 6.

As best seen in FIGS. 2, 4 and 8, the carriage 172 mounts four rollers 176 which are movable along a fixed guide rail 178 carried by a vertical post 192 of the support frame 182. The carriage 174, mounted to the opposite side of mounting rod 170, has four rollers 198 which are movable along a guide rail 200 carried on a vertical, center plate 202. The several stack support arms 164 are raised and lowered with respect to the take off conveyor 55 by carriages 172, 174 and the drive arrangement illustrated in FIGS. 4, 6 and 8. The endmost stack support arm 164, i.e., closest to the guide rail 178, is formed with an extension 204 fixed to an endless lift chain 206 which extends between an upper sprocket 208 and a lower sprocket 210. The lower sprocket 210 is mounted on a shaft 212 which extends to the center plate 202 and is rotatably mounted in a journal 213. A driven sprocket 214 also mounted to shaft 212, is drivingly connected by an endless drive chain 216 to a drive sprocket 218 carried on the output shaft 219 of a gear reducer 220. This gear reducer 220 is drivingly connected to a reversible motor 222.

In response to operation of the reversible motor 222 and gear reducer 220, the drive chain 216 causes the sprocket 214 to rotate, which, in turn rotates the shaft 212. Rotation of the shaft 212 drives the lower sprocket 210, so that the lift chain 206 associated with the carriage 172 moves in a clockwise or counterclockwise direction. The carriage 174 at the center of support frame 182 is also provided with a similar drive including a lower sprocket 210, lift chain 206 and upper sprocket (not shown). When moving in the clockwise direction, as viewed in the FIGS., the lift chains 206 move the stack support arms 164 downwardly with respect to the take off conveyor 55, whereas the stack support arms 164 are lifted upwardly by lift chains 206 upon rotation of the upper and lower sprockets 208, 210 in the counterclockwise direction.

In the presently preferred embodiment, the motor 222 operates to slowly lower the separated stack 16 relative to the take off conveyor 55 as it builds on the stack support arms 164. A weight sensor 226, illustrated in phantom in FIG. 4, functions to sense the initial presence of the sheets forming separated stack 16 as it builds on the stack support arms 164. The speed of the motor 222 matches the speed of the short belts 47 and long belts 45 of take off conveyor 55 prior to the initiation of a stack separating operation. As described in detail below, the speed of short belts 47 is increased after the stack separating operation is performed, and the speed of motor 222 is also increased to equal that of the short belts 47 so that the stack support arms 164 move downwardly at the same pace as the short belts 47 remove the stack 16 from the take off conveyor 55. Once the entire separated stack 16 is removed from take off conveyor 55, the motor 222 is operated at high speed so that the stack support arms 164 quickly move to a lowermost, stack take off position in which the stack support arms 164 are at the same level as the L-shaped pusher blades 166. Once the separated stack 16 is removed from the stack support arms 164, the direction of motor 222 is reversed to quickly move the lift chains 206 in the opposite, counterclockwise direction so that the stack support arms 164 are returned to their uppermost position immediately beneath the take off conveyor 55.

The foregoing structure therefore performs the functions of (1) receiving the separated stack 16 from the take off conveyor 55, (2) allowing the separated stack 16 to slowly build on the stack support arms 164 as additional folded sheets 18 are transferred thereto from the take off conveyor 55 and then (3) transferring the fully formed separated stack 16 into position at the L-shaped pusher blades 166. Movement of the stack support arms 164 is achieved positively and quickly so that the stack take away operation from the take off conveyor 55 can proceed without requiring a slow down of the operation of zigzag folder 12 and/or the stack spreading and cutting mechanism 34.

Transfer of Stack from Stack Support Arms to Discharge Conveyor

As described in the previous section, the stack support arms 164 move the separated stack 16 vertically downwardly from a position adjacent the take off conveyor 55 to a position in alignment with the L-shaped pusher blades 166. This section discusses the operation of the L-shaped pusher blades 166 in transferring the separated stack 16 onto the discharge conveyor 162 for further handling.

As mentioned above, a number of L-shaped pusher blades 166 are laterally spaced along the support frame 182 and are interleaved between adjacent stack support arms 164. Referring to FIGS. 5–8, each of the L-shaped pusher blades 166 is mounted on a carrier chain 228 which moves the pusher blades 166 from a stack receiving position adjacent the lift arms 164 to a stack discharge position adjacent the discharge conveyor 162. Each carrier chain 228 extends longitudinally along the length of support frame 182 within a channel support 230 mounted at its opposite ends to the upper cross members 184 of support frame 182. The carrier chains 228 each extend around an upstream idler sprocket 234 carried on a separate shaft 236 associated with each channel support 230 (FIG. 7), and a downstream idler sprocket 238 carried on a shaft 240. As viewed in FIG. 5, this shaft 240 is journaled at one end to the outermost channel support 230, and at the opposite end to the channel support 230*y* located at the center of support frame 182.

Figure 6:
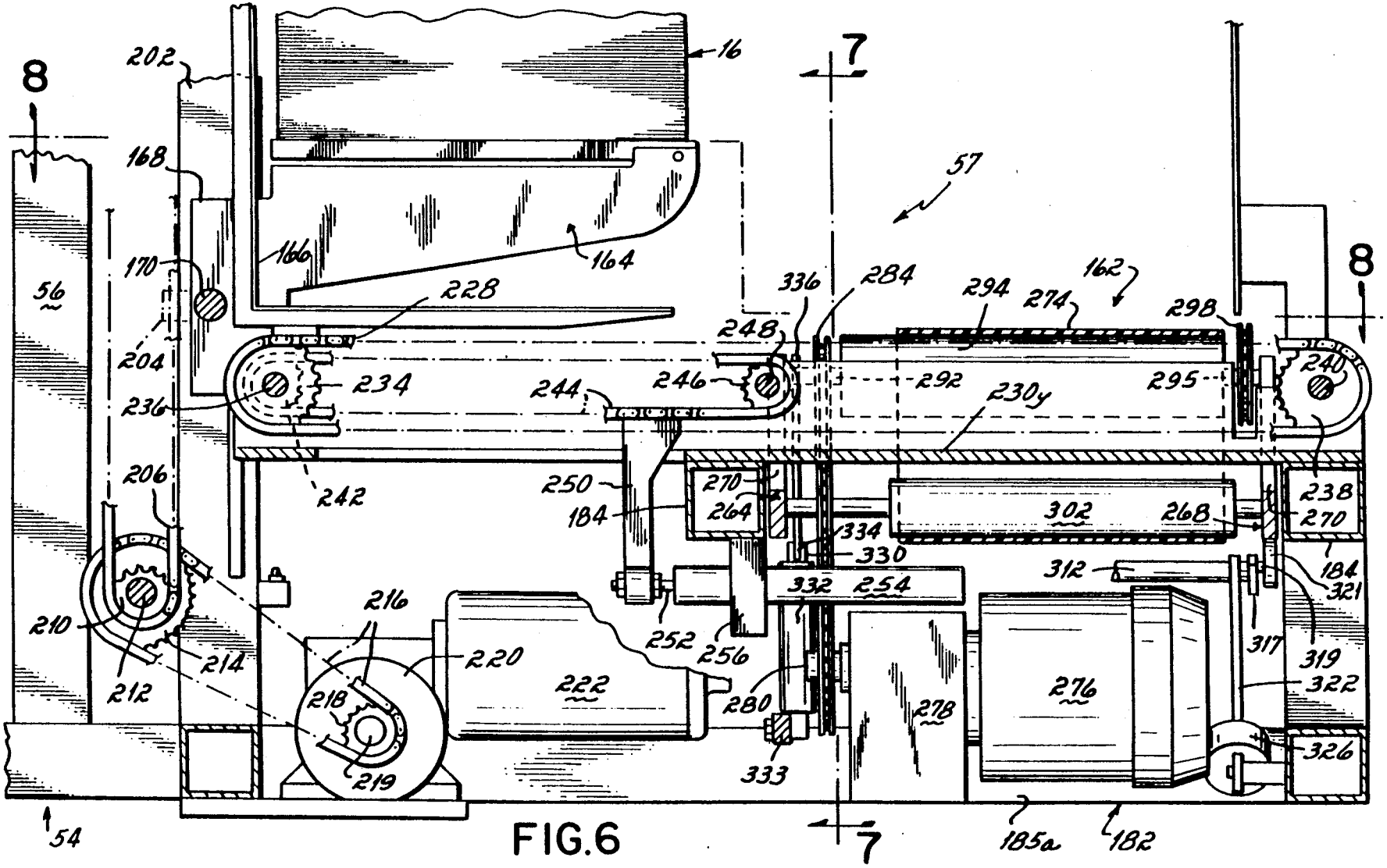
FIG. 6 is a cross sectional view of the stack removal mechanism taken generally along lines 6—6 of FIG. 5.

Referring to the lefthand side of FIG. 6 and FIG. 8, the shaft 236 associated with the center channel support 230*y* also rotatably mounts a follower sprocket 242 which is connected by a drive chain 244 to a smaller diameter idler sprocket 246. This idler sprocket 246 is rotatably mounted on shaft 248 fixed to the center area of channel support 230*y* between its upstream and downstream ends. The drive chain 244 is connected by a drive arm 250 to the cylinder rod 252 of a pneumatic cylinder 254 carried by a bracket 256 on the cross support 184. In response to extension of the cylinder rod 252, the drive arm 250 moves the drive chain 244 in a clockwise direction thus rotating the shafts 236 and 248 in the same direction. Rotation of the shaft 236 causes the idler sprocket 234 to rotation, which, in turn, drives the carrier chain 228 associated with the center channel support 230*y*. The center carrier chain 228 drives the downstream idler sprocket 238 associated with the center channel support 230*y*, thus rotating the shaft 240 and each of the other downstream idler sprockets 238 mounted to shaft 240. In turn, the pusher blades 166 mounted to each carrier chain 228 are advanced in a "downstream" direction, i.e., to the right as viewed in FIG. 6, to a position immediately above the discharge conveyor 162. The diameter of the sprockets 242 and 246 compared to the diameter of the idler sprocket 234 is such that a single extension of the cylinder rod 252 is sufficient to move the carrier chains 228, and thus the pusher blades 166, from the stack receiving position adjacent the lift arms 164 to a stack discharge position adjacent the discharge conveyor 162. Preferably, a 5-to-3 ratio is obtained between the cylinder rod 252 extension and the movement of pusher blades 166, i.e., the length of travel of the pusher blades 166 is 5/3 of the length of extension of cylinder rod 252.

The aforementioned structure therefore permits movement of the L-shaped pusher blades 166 in a downstream and upstream direction so that the separated stack 16 can be received from the stack support arms 164 and transferred to the discharge conveyor 162. Further structure is provided in the apparatus 10 of this invention to permit removal of the separated stack 16 onto the discharge conveyor 162, and to then transfer the separated stack 16 thereon.

With reference again to FIGS. 2 and 5–8, the discharge conveyor 162 comprises a number of idler rollers 260 each carried by a shaft which has an upstream end 262 connected to an upstream frame member 264 and a downstream end 266 connected to a downstream frame member 268. As depicted in FIG. 2, the frames 264 and 268 contain U-shaped cut-outs 270 defining shoulders 272 through which the channel supports 230 are allowed to extend beneath the run of conveyor 162. An endless, discharge belt 274 extends around the idler rollers 260 and is positively driven by the drive structure best shown in FIGS. 5–7. This drive structure comprises a motor 276 which is connected to a gear reducer 278 having an output shaft 280 which carries a lower sprocket 282. Lower sprocket 282 is connected by a drive chain 284 to a drive sprocket 286 associated with the stack take away mechanism 163 shown on the lefthand side of FIG. 7 for handling a separated stack 16, and a second drive sprocket 288 associated with the stack take away mechanism 163*a* on the righthand side of FIG. 7 for handling a separated stack 16*a*. As mentioned above, each of the stack take away mechanisms 163, 163*a* associated with support frame 182 operate in the identical manner as described above, and only the construction of the stack take away mechanism 163 associated with separated stack 16 is described herein. See lefthand side of FIG. 7, and FIGS. 5, 6.

The drive sprocket 286 is mounted at the upstream end 292 of a shaft which carries a conveyor roller 294 located near the center of support frame 182. A downstream end 295 of the shaft carrying the drive roller 294 mounts a driven sprocket 296. See FIG. 5. This drive sprocket 296 is connected by a driven chain 298 to a sprocket 300 mounted to the downstream end 266 of the aforementioned shaft for the outermost idler roller 260*x*. See FIGS. 2 and 5. In response to operation of motor 276 and gear reducer 278, the drive chain 284 causes drive sprocket 286 to rotate the drive roller 294 and the driven sprocket 296. Rotation of the driven sprocket 296 causes the driven chain 288 to rotate the sprocket 300 connected to the outermost idler roller 260*x*. In turn, the endless belt 274 is rotated by drive roller 294 and the outermost idler roller 260*x* over the remaining idler rollers 260. As mentioned above, the identical belt drive structure is provided on the right-hand side of frame support 182 associated with the second, separated stack 16*a*. Preferably, the endless belt 274 extends over a pair of lower idlers 302 and 304, the outermost idler roller 260' and a tension adjustment roller 306 mounted to brackets 308 and 309 which are extensions of frame members 264 and 268, respectively. See FIGS. 5 and 8.

Figure 5:
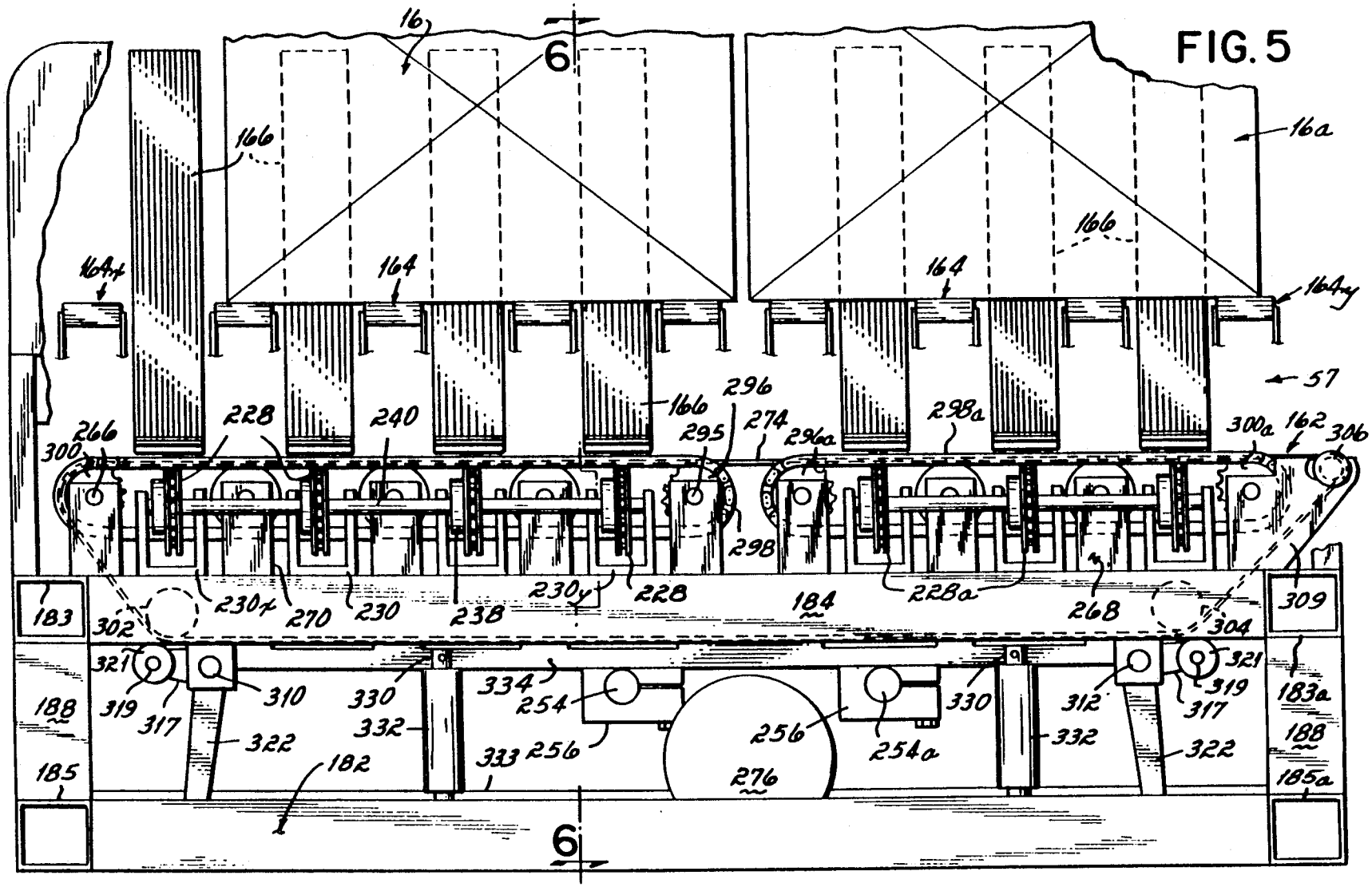
FIG. 5 is a partially broken away, end view of the stack removal mechanism.
Figure 7:
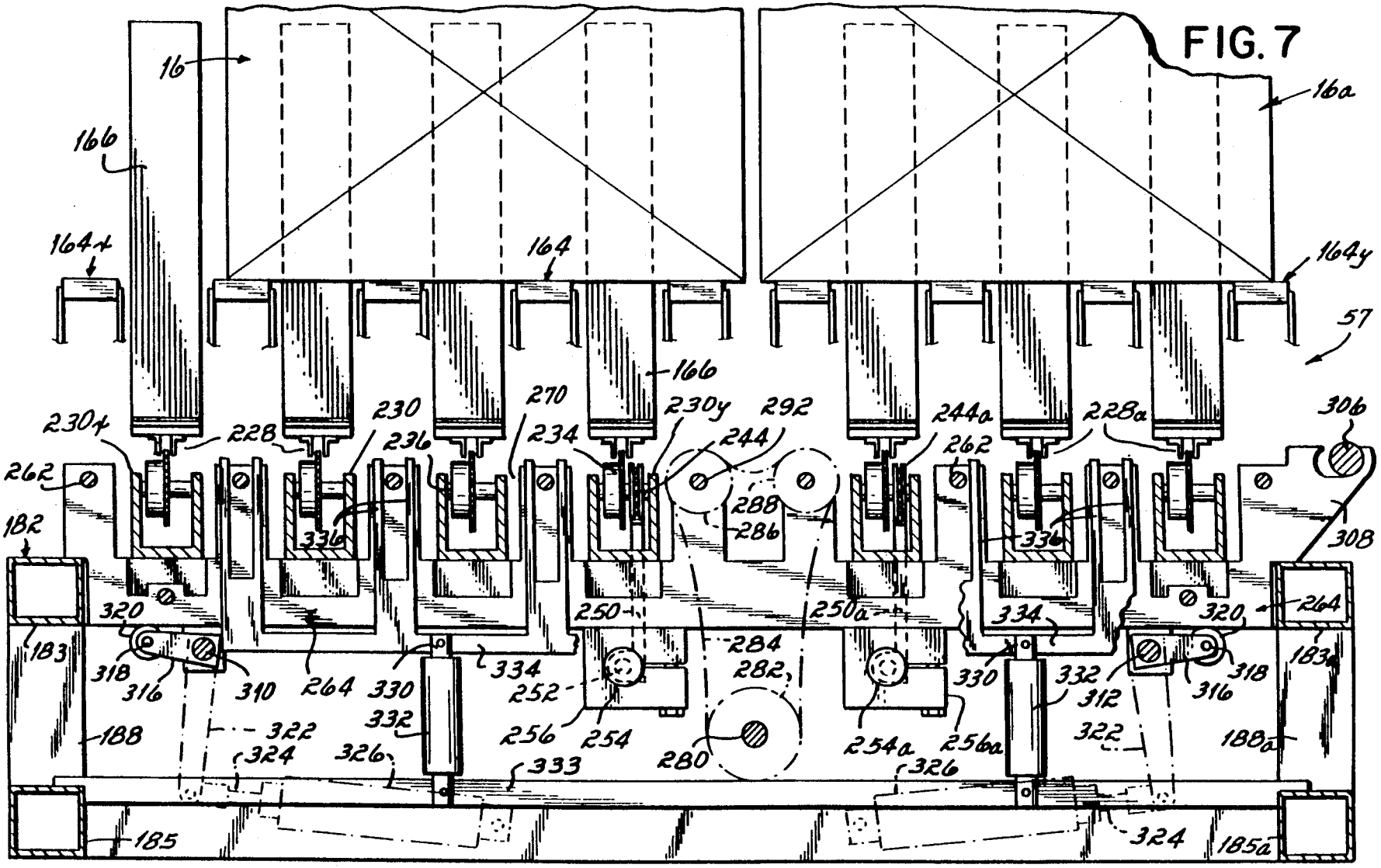
FIG. 7 is an other cross sectional view of the stack removal mechanism taken generally along lines 7—7 of FIG. 6.

The actual deposit of the separated stack 16 onto the endless belt 274 requires two operations in addition to movement of the L-shaped pusher blades 166 to a position above the endless belt 274. In the presently preferred embodiment, the upstream frame 264 and downstream frame 268 which support the idler rollers 260 are movable between a lowered, stack receiving position and a raised stack transfer position. As best shown in FIGS. 5, 6 and 7, lift rods 310 and 312 are positioned beneath the frames 264, 268 on opposite sides of the support frame 182. Each lift rod 310, 312 mounts an upstream crank arm 316 connected by a shaft 318 to an upstream lift roller 320 which engages the bottom of rear frame 264. Similarly, the lift rods 310, 312 each mount a downstream crank arm 317 which is connected by a stub shaft 319 to a downstream lift roller 321 which engages the bottom of front frame 268. Additionally, each lift rod 310 and 312 is connected to one end of a tie rod 322 whose opposite end is mounted to the cylinder rod 324 of a cylinder 326 fixed to cross member 188. In response to extension of the cylinder rod 324 of each cylinder 326, the tie rods 322 pivot the lift rods 310, 312, which, in turn, cause the crank arms 316, 317 to move the upstream and downstream lift rollers 320, 321 in a vertically upward direction. In response to upward movement of lift rollers 320, 321, the rear frame 264 and front frame 268 are moved upwardly which raises the idler rollers 260 and endless belt 274 carried thereon. Because the drive sprockets 286, 288 are mounted on the rear frame 264, they too move upwardly and the slack in the drive chain 284 connected thereto is taken up upon upward vertical movement of the rear frame 264 and front frame 268. See FIG. 7.

The purpose of providing for vertical movement of the endless belt 274 is to permit the pusher blades 166 to advance to a stack discharge position over the endless belt 274 without interfering therewith. Once the pusher blades 166 are retracted from above the endless belt 274, the endless belt 274 can be moved vertically upwardly as described above to contact the separated stack 16 and move it to a location for further processing.

In order to ensure the smooth transfer of the separated stack 16 from the pusher blades 166 onto the endless belt 274, structure is provided to hold the separated stack in position above the endless belt 274 while the pusher blades 166 are moved back to the stack receiving position. As viewed in FIG. 7, the cylinder rods 330 of a pair of cylinders 332 carried by a cross support 333 mounts a lift frame 334 which includes a number of upright, stack retention fingers 336. These fingers 336 ar longitudinally spaced along substantially the entire width of support frame 182 in between the path of movement of the pusher blades 166 associated with the separated stack 16 to accommodate both separated stacks 16 and 16*a*. After the pusher blades 166 have moved a separated stack 16 to a position above the endless belt 274, the cylinder 332 is activated to move the lift frame 334 and its stack retention fingers 336 upwardly, immediately upstream from the separated stack 16. When the pusher blades 166 are withdrawn from above the endless belt 274, these stack retention fingers 336 engage the separated stack 16 or 16*a* and prevent it from moving with the pusher blades 166 so that the separated stack 16 or 16*a* is transferred onto the endless belt 274. The stack retention fingers 336 are then lowered by operation of cylinder 332 in preparation for another separated stack 16.

Operation of Apparatus

With reference to FIGS. 1 and 4–4D, the stack separator apparatus 10 operates as follows. As mentioned above, operation of only one side of the stack separator apparatus 10 is described herein, it being understood that the opposite side of the apparatus 10 for use with zigzag folder 12*b* and main stack 14*b* is structurally and functionally identical.

The zigzag folder 12 is operative to discharge a main stack 14 of folded sheets 18 onto the feed conveyor 20 so that the sheets 18 rest on their folded edges 19 where they are interconnected by perforations (not shown). The feed conveyor 20 is angled slightly in a downstream direction so that the folded sheets 18 are not oriented strictly vertically upon the feed conveyor 20, but are bowed in a convexly arcuate shape. Such angulation of the folded sheets 18 is also attributable to their weight as they are folded one upon the other in forming the main stack 14.

An important aspect of this invention is predicated upon the concept of obtaining repeatable and accurate separation of adjacent folded sheets 18 in the main stack 14 at the stack spreading and cutting mechanism 34 so that such sheets can be cut along their perforations without tearing or otherwise damaging the sheets. This separating and cutting operation is illustrated in the sequence of FIGS. 4–4D. Initially, the divider plate 132, flexible cutter 102 and separator blade 160 are each carried in a retracted position above the main stack 14. At selected intervals, the optical scanner 30 carried on the feed conveyor frame 22 senses the presence of a stack division line 28 on the side edge of main stack 14 and initiates the stack spreading and cutting operations. Initially, the divider plate 132 is rotated downwardly into the main stack 14 and between adjacent folded sheets 18, thus defining the first sheet 134 of the main stack 14 and the last sheet 136 of what will be a separated stack 16 after the cutting operation is performed. As described above, the divider plate 132 contacts the first sheet 134 of main stack 14, and is then pulled in an upstream direction by pneumatic cylinder 124 as viewed in FIG. 4A. The divider plate 132 therefore creates a partial clearance 138 between the first and last sheets 134, 136 and restrains further downstream motion of the main stack 14 until such time as the cutting operation can be completed.

The next step in the sequence of operation is to activate the separator blade 160. As described above, the pneumatic cylinders 142, 144 operate to first advance the separator blade 160 along the upper portion 156 of arcuate slot 154 so that the separator blade 160 can enter the partially formed gap or clearance 138 between the first and last sheets 134, 136 to be separated. Activation of the second cylinder 144 causes the rollers 152 and carriage 150 to move along the lower portion 158 of arcuate slot 154, which, in turn, moves the separator blade 160 against the last sheet 134 of separated stack 16 and forces such separated stack 16 in a downstream direction. See FIG. 4C. The divider plate 132 and separator blade 160 therefore cooperate to provide a substantial clearance 138 between the first and last sheets 134, 136, and such clearance 138 is obtained by positively contacting and moving apart each of the first and last sheets 134, 136.

Having separated the first and last sheets 134, 136, the cutting operation can now proceed. The cylinder 66 which carries flexible cutter 102 is rotated as described above so that the flexible cutter 102 slides along the slots 67 and 69 formed in the side plates 38, 42, respectively. As viewed in FIG. 4D, the flexible cutter 102, which is preferably formed of a polycarbonate material, is "unwrapped" from the cylinder 66 and extended within the clearance 138 between the first and last sheets 134, 136. In this unwrapped condition, the flexible cutter 102 assumes a convexly arcuate shape which generally corresponds to the "bow" or convexly arcuate shape of the folded sheets 18 in main stack 14. As the leading, cutting edge 104 of flexible cutter 102 approaches the perforation between the first and last sheets 134, 136, such cutting edge 104 is substantially parallel to the feed conveyor 20 and take off conveyor 55. The cutting edge 104 contacts the perforation between the first and last sheets 134, 136, along the entire width of such sheets, and cuts or breaks the perforation so that a clean and precise separation of the sheets is obtained. The formation of a substantial and controlled clearance 138 between the first and last sheets 134, 136, in combination with the configuration and movement of flexible cutter 102, assures that minimal ripping or tearing of either sheet 134, 136 is created during a cutting operation.

Once the last sheet 136 of the separated stack 16 is cut from the first sheet 134 of main stack 14, it is desirable to increase the speed of take off conveyor 55 to quickly transfer the sheets 18 of separated stack 16 which remain on the take off conveyor 55 to the stack support arms 164. As viewed in FIGS. 1A and 4D, this increase in speed of the take off conveyor 55 is obtained with a drive train which consists of a motor 342 having a "once around" clutch 343 and a output shaft 344 connected to a relatively large diameter sprocket 346. The sprocket 346 is drivingly connected by a chain 348 to a driven sprocket 350 which is mounted on a shaft 352 carrying the intermediate pulleys 75 over which each of the short belts 47 of take off conveyor 55 is extended as mentioned above. The output shaft 344 of motor 342 also mounts a sprocket 360 connected by a chain 358 to the output of an encoder 340. As viewed in FIG. 4, the diameter of sprocket 360 is less than that of sprocket 346.

Prior to a stack spreading and cutting operation, the motor 342 is operative to drive the driven sprocket 346, but the clutch 343 is permitted to slip so that the chain 348 does not drive the driven sprocket 350. In timed sequence with a cutting operation, the clutch 343 is caused to engage the smaller diameter sprocket 360 and drive it "once around" or a single revolution. This, in turn, drives the sprocket 346, chain 348, sprocket 350 and, in turn, the intermediate shaft 352 at a faster pace. Because each of the short belts 47 are mounted by pulleys 75 to the intermediate shaft 352, these belts 47 are rotated at the same, faster speed. In turn, short belts 47 drive the downstream shaft 59 through pulleys 75 at a faster pace so that the remaining sheets 16 of separated stack 16 are quickly removed from the take off conveyor 55 and deposited onto the lift arms 164. During the accelerated movement of short belts 47, the long belts 45 continue to rotate at a constant, slower speed, i.e., the same as main feed conveyor belts 27, because the roller clutch mechanism 79 which carries each long belt 45 slips on shaft 59 so that the faster pace of short belts 47 is not transmitted to the long belts 45.

While the separated stack 16 is being removed from the area of the stack spreading and cutting mechanism 34 at an accelerated pace by the take off conveyor 55, the divider plate 132, flexible cutter 102 and separator blade 160 all cooperate to at least temporarily restrain motion of the main stack 14 in a downstream direction. During this temporary stack holding period, the divider plate 132 and flexible cutter 102 remain in their extended positions, while the separator blade 160 is moved to its intermediate position, i.e., the cylinder 144 operates to move the rollers 152 and carriage 150 along the lower portion 158 of arcuate slot 154 to the beginning of the upper portion 156 thereof. This causes the separator blade 160 to move in an upstream and vertically upward direction into contact with the rear surface of the flexible cutter 102 See FIG. 4D. Such contact of the separator blade 160 with the flexible cutter 102 is intended to provide support for the flexible cutter 102 while it engages the main stack 14 so that the flexible cutter 102 is not damaged. After a short period of time, the flexible cutter 102 is retracted by rotation of cylinder 66, the separator blade 160 is moved to a retracted position by operation of the second pneumatic cylinder 142 and then the divider plate 132 is returned to its retracted position as described above. This allows the main stack 14 of folded sheets 18 to continue downstream movement onto the take off conveyor 55.

The handling of separated stack 16 from the take off conveyor 55 to the discharge conveyor 162 proceeds as described above. In timed sequence with the performance of the cutting operation, the reversible motor 222 is operated to positively move the stack support arms 164 downwardly at the same speed as belts 45, 57 of take off conveyor 55. After the stack 16 is separated, and the belts 45, 45 are accelerated to remove the separated stack 16 from take off conveyor 55 as described above, the speed of motor 222 is increased to match the speed of belts 45, 47 so that the stack support arms 164 descend at the same pace as the movement of stack 16 from the take off conveyor 55. Once the separated stack 16 is completely removed from take off conveyor 55, the motor 222 is operated at high speed to quickly move the stack support arms 164 downwardly and deposit the stack 16 onto the L-shaped pusher blades 166. The pusher blades 166 are then activated in the manner described above to advance the separated stack 16 into a position above the endless belt 274 of discharge conveyor 162. After the pusher blades 166 have been activated, the stack support arms 164 are immediately raised by operation of reversible motor 222 and carrier chain 228 into position adjacent the take off conveyor 55 as described above.

The separated stack 16 is deposited onto the endless belt 274 of discharge conveyor 162 and the stack retention fingers 336 are moved to the raised position, i.e., behind or upstream from the stack 16, so that the pusher blades 166 can be retracted and moved back to a stack receiving position beneath the stack support arms 164. The endless belt 274 of discharge conveyor 162 is then raised upwardly to transfer the separated stack 16 to a remote location for further processing while the stack retention fingers 336 are moved to a lowered position in preparation for another stack 16. The operation described above is then repeated for another separated stack 16.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, an optical scanner 30 is employed to sense a stack division line 28 in order to initiate the stack spreading and cutting operation. It is contemplated that other means could be used to initiate such operation, such as an ultraviolet sensor, a programmable controller and other suitable sheet sensing and/or counting means.

Additionally, while the apparatus 10 is illustrated with two main stacks 14, 14*a*, it should be understood that a total of three main stacks could be accommodated by adding an additional divider plate 132 on the stack spreading and cutting mechanism 34 so that a total of three divider plates 132 are provided, one for each stack.

Therefore, it is intended that the invention not be limited to the particular embodiment disclosed as the best mode contemplated for carrying out this invention, but that the invention will include all embodiments falling within the scope of the appended claims.

I claim:

1. Apparatus for forming a separated stack of zigzag folded sheets, which are interconnected at adjacent, folded ends by perforations, from a main stack of sheets, comprising:

conveyor means for transmitting the main stack of sheets on their folded ends downstream to a stack spreading and cutting station, the main stack having a top side and a bottom side which rests atop said conveyor means;

first separator means, located at said stack spreading and cutting station in a position to enter the main stack between adjacent upstream and downstream sheets in a direction from said top side of the main stack toward said bottom side thereof, for contacting said upstream sheet to restrain downstream movement of the main stack and to provide clearance between said upstream and downstream sheets;

second separator means located at said stack spreading and cutting station for contacting said downstream sheet to provide additional clearance between said upstream and downstream sheets;

cutter means movable within said clearance formed between said upstream and downstream sheets in a direction toward said conveyor means for separating said sheets at the perforation along said folded end therebetween to form a separated stack of folded sheets downstream from the main stack;

take away means for removing said generated stack from said stack spreading and cutting station while at least one of said first separator means, cutter means and second separator means at least temporarily restrains the main stack from downstream movement relative to said stack spreading and cutting station.

2. The apparatus of claim 1 in which said first separator means comprises:

a divider plate;

means for rotating said divider plate from a first position above said top side of the main stack to a second position wherein said divider plate extends between said adjacent, upstream and downstream sheets.

3. The apparatus of claim 2 in which said separator means further comprises retraction means for moving said divider plate in an upstream direction, said retraction means being operable after movement of said divider plate to said second position so that said divider plate contacts said upstream sheet and forces the main stack in an upstream direction relative to said stack spreading and cutting station.

4. The apparatus of claim 1 in which said second separator means comprises:

a separator blade;

first means for moving said separator blade between said upstream and downstream sheets;

second means for thereafter moving said separator blade in a downstream direction against said downstream sheet to provide clearance between said upstream and downstream sheets.

5. The apparatus of claim 4 including a support frame for supporting said cutter means and said first and second separator means, said separator blade being mounted to a carriage having rollers movable within an arcuate slot formed in said support frame, said first means comprising a first cylinder for moving said carriage along a portion of said arcuate slot so that said separator blade moves in an upstream direction and between said upstream and downstream sheets, said second means comprising a second cylinder for moving said carriage along another portion of said arcuate slot so that said separator blade moves in a downstream direction and against said downstream sheet.

6. The apparatus of claim 1 in which said cutter means is a flexible cutting sheet having a leading, cutting edge which is effective to separate said upstream and downstream sheets at the perforation therebetween.

7. The apparatus of claim 6 in which said conveyor means transmits said sheets on their folded ends so that said sheets are bowed in a convexly arcuate shape in the course of moving downstream to said stack spreading and cutting station, said flexible cutting sheet being formed in a convexly arcuate shape substantially corresponding to the bow of said sheets so that said leading, cutting edge thereof extends substantially parallel to said conveyor means upon contact with the perforation between said upstream and downstream sheets.

8. The apparatus of claim 7 further including a cylinder which mounts said convexly arcuate, flexible cutting sheet, and means for rotating said cylinder to extend and retract said flexible cutting sheet with respect to the perforation between said upstream and downstream sheets.

9. The apparatus of claim 1 in which said take away means comprises:

a take off conveyor;

means for operating said take off conveyor at a speed in excess of that of said conveyor means after separation of said separated stack from said main stack so that said separated stack is conveyed from said cutting station at a faster rate than said main stack is conveyed to said cutting station; and stack transfer means for receiving said separated stack from said take off conveyor and moving said separated stack to another location.

10. The apparatus of claim 9 in which said stack transfer means comprises:

a number of stack support arms for receiving said separated stack;

means for vertically raising and lowering said stack support arms relative to said take off conveyor between an uppermost position and a lowermost position;

a number of spaced pusher blades movable between said lowermost position and a stack discharge position;

a discharge conveyor located at said stack discharge position;

means for moving said pusher blades in a horizontal direction to remove said separated stack from said stack support arms at said lowermost position, and to transfer said separated stack onto said discharge conveyor of said stack discharge position;

stack retaining means for retaining said separated stack at said stack discharge position in the course of movement of said pusher blades from said discharge position to said lowermost position.

11. The apparatus of claim 10 in which said stack retaining means comprises a number of fingers movable to an extended position in between said pusher blades with said pusher blades and said separated stack located at said stack discharge position so that said fingers contact said separated stack upon movement of said pusher blades back to said lowermost position and retain said separated stack on said discharge conveyor.

12. Apparatus for forming a separated stack of zigzag folded sheets, which are interconnected at adjacent, folded ends by perforations, from a main stack of sheets, comprising:

conveyor means for transmitting the main stack of sheets on their folded ends to a stack spreading and cutting station;

first separator means located at said stack spreading and cutting station for spreading adjacent upstream and downstream sheets of the main stack;

means for moving said first separator means in an upstream direction, against said upstream sheet, to restrain downstream movement of the main stack relative to said stack spreading and cutting station;

second separator means located at said stack spreading and cutting station for contacting said downstream sheet to provide clearance between said upstream and downstream sheets;

cutter means movable within said clearance formed between said upstream and downstream sheets for separating said sheets along the perforation therebetween to form a separated stack of folded sheets downstream from the main stack;

take away means for removing said separated stack from said stack spreading and cutting station while at least one of said first separator means, cutter means and second separator means at least temporarily restrains the main stack from downstream movement relative to said stack spreading and cutting station.

13. The apparatus of claim 12 in which said first separator means comprises:

a divider plate;

means for rotating said divider plate from a first position above the main stack to a second position wherein said divider plate extends between said adjacent, upstream and downstream sheets.

14. The apparatus of claim 13 in which said means for moving said first separator means comprises a cylinder having a cylinder rod connected to said divider plate so that actuation of said cylinder causes said cylinder rod to move said divider plate in an upstream direction.

15. Apparatus for forming a separated stack of zigzag folded sheets, which are interconnected at adjacent, folded ends by perforations, from a main stack of sheets, comprising:

conveyor means for transmitting the main stack of sheets on their folded ends to a stack spreading and cutting station;

first separator means located at said stack spreading and cutting station for spreading adjacent upstream and downstream sheets of the main stack, said first separator means contacting said upstream sheet to restrain downstream movement of the main stack;

second separator means located at said stack spreading and cutting station for assisting said first separator means in spreading said upstream and downstream sheets;

means for moving said second separator means between said upstream and downstream sheets, and for thereafter moving said separator means in a downstream direction against said downstream sheet to provide clearance between said upstream and downstream sheets;

cutter means movable within said clearance formed between said upstream and downstream sheets for separating said sheets along the perforation therebetween to form a separated stack of folded sheets downstream from the main stack;

take away means for removing said separated stack from said stack spreading and cutting station while at least one of said first separator means, cutter means and second separator means at least temporarily restrains the main stack from downstream movement relative to said stack spreading and cutting station.

16. The apparatus of claim 15 including a support frame and wherein said second separator means is a separator blade, said means for moving said second separator means comprising a carriage having rollers movable within an arcuate slot formed in said support frame, said first means comprising a first cylinder for moving said carriage along a portion of said arcuate slot so that said separator blade moves in an upstream direction and between said upstream and downstream sheets, said second means comprising a second cylinder for moving said carriage along another portion of said arcuate slot so that said separator blade moves in a downstream direction and against said downstream sheet.

17. Apparatus for forming a separated stack of zigzag folded sheets, which are interconnected at adjacent, folded ends by perforations, from a main stack of sheets, comprising:

conveyor means for transmitting the main stack of sheets on their folded ends to a stack spreading and cutting station;

first separator means located at said stack spreading and cutting station for spreading adjacent upstream and downstream sheets of the main stack;

means for moving said first separator means in an upstream direction, against said upstream sheet, to restrain downstream movement of the main stack relative to said stack spreading and cutting station;

second separator means located at said stack spreading and cutting station for assisting said first separator means in spreading said upstream and downstream sheets;

means for moving said second separator means between said upstream and downstream sheets, and for thereafter moving said separator blade in a downstream direction against said downstream sheet to provide clearance between said upstream and downstream sheets;

cutter means movable within said clearance formed between said upstream and downstream sheets for separating said sheets along the perforation therebetween to form a separated stack of folded sheets downstream from the main stack;

take away means for removing said separated stack from said stack spreading and cutting station while at least one of said first separator means, cutter means and second separator means at least temporarily restrains the main stack from downstream movement relative to said stack spreading and cutting station.

18. The apparatus of claim 17 in which said first separator means comprises:

a divider plate;

means for rotating said divider plate from a first position above the main stack to a second position wherein said divider plate extends between said adjacent, upstream and downstream sheets.

19. The apparatus of claim 18 in which said means for moving said first separator means comprises a cylinder having a cylinder rod connected to said divider plate so that actuation of said cylinder causes said cylinder rod to move said divider plate in an upstream direction.

20. The apparatus of claim 17 including a support frame and wherein said second separator means is a separator blade, said means for moving said second separator means comprising a carriage having rollers movable within an arcuate slot formed in said support frame, said first means comprising a first cylinder for moving said carriage along a portion of said arcuate slot so that said separator blade moves in an upstream direction and between said upstream and downstream sheets, said second means comprising a second cylinder for moving said carriage along another portion of said arcuate slot so that said separator blade moves in a downstream direction and against said downstream sheet.

21. Apparatus for forming a separated stack of zigzag folded sheets, which are interconnected at adjacent, folded ends by perforations, from a main stack of sheets, comprising:

conveyor means for transmitting the main stack of sheets on their folded ends to a stack spreading and cutting station;

a support frame located at said stack spreading and cutting station, said support frame rotatably mounting a cylinder having an exterior surface;

first separator means carried by said support frame for spreading adjacent upstream and downstream sheets of the main stack, said first separator means contacting said upstream sheet to restrain downstream movement of the main stack;

second separator means carried by said support frame for contacting said downstream sheet to provide clearance between said upstream and downstream sheets;

a flexible cutting member carried on said exterior surface of said cylinder, said flexible cutting member being effective in response to rotation of said cylinder to extend into said clearance formed between said upstream and downstream sheets and to separate said sheets along the perforation therebetween to form a separated stack of folded sheets downstream from the main stack;

take away means for removing said separated stack from said stack spreading and cutting station while at least one of said first separator means, cutter means and second separator means at least temporarily restrains the main stack from downstream movement relative to said stack spreading and cutting station.

22. The apparatus of claim 21 in which said flexible cutting member is a sheet of a polycarbonate material.

23. The apparatus of claim 21 in which said flexible cutting member has a substantially convexly arcuate shape in the downstream direction when extended between said upstream and downstream sheets.

24. The method of forming a separated stack of zigzag folded sheets from a main stack, comprising:

transmitting the main stack of sheets on their folded ends in a downstream direction atop a conveyor, the main stack having a top side and a bottom side which rests atop the conveyor;

inserting a first separator into the main stack between adjacent upstream and downstream sheets in a direction from the top side of the main stack toward the bottom side thereof;

providing clearance between the upstream sheet and the downstream sheet by moving the first separator in an upstream direction against the upstream sheet, and by contacting the downstream sheet with a second separator which moves in the downstream direction;

extending a cutting means into the clearance between the upstream sheet and downstream sheet in a direction toward the conveyor and separating the upstream and downstream sheets at the perforation along the folded end therebetween to form a separated stack from the main stack.

25. The method of claim 24 in which said step of inserting a first separator comprises inserting a divider plate between adjacent upstream and downstream sheets in the main stack.

26. The method of claim 25 in which said step of providing clearance between the upstream sheet and downstream sheet comprises:

(i) moving the divider plate in an upstream direction against the upstream sheet to restrain the main stack from moving in a downstream direction; and (ii) contacting the downstream sheet with the second separator which applies a force in the downstream direction to the separated stack to force the downstream sheet away from the upstream sheet and the main stack.

27. The method of claim 24 in which said step of extending a cutting means comprises inserting a flexible cutter into the clearance between the upstream and downstream sheets so that the leading, cutting edge of the flexible, cutter contacts the perforations connecting the upstream and downstream sheets in a plane substantially parallel to the direction of movement of the main stack.

28. The method of claim 27 in which said step of extending a cutting means comprises rotating a cylinder which carries the flexible cutter in a first direction to unwind and extend the flexible cutter sheet from the cylinder into the clearance between the upstream and downstream sheets.

29. The method of forming a separated stack of zigzag folded sheets from a main stack, comprising:

transmitting the main stack of sheets in a downstream direction on their folded ends atop a conveyor, the main stack having a top side and a bottom side resting on the conveyor;

inserting a separator into the main stack between adjacent upstream and downstream sheets in a direction from the top side toward the bottom side thereof;

moving the separator in an upstream direction against the upstream sheet to restrain downstream movement of the main stack and to provide clearance between the upstream and downstream sheets;

extending a cutting means into the clearance between the upstream and downstream sheets in a direction from the top side toward the bottom side of the main stack, and separating the upstream and downstream sheets at the perforation along the folded end therebetween to form a separated stack from the main stack.

* * * * *

UNITED STATES PATENT AND TRADEMARK OFFICE

CERTIFICATE OF CORRECTION

PATENT NO. : 5,090,678

DATED : February 25, 1992

INVENTOR(S) : Robert L. Green

It is certified that error appears in the above-identified patent and that said Letters Patent is hereby corrected as shown below:

Column 17, line 4, "generated" should be --separated--.

Signed and Sealed this

Tenth Day of August, 1993

*Attest:*

Michael K. Kirk

MICHAEL K. KIRK

*Attesting Officer*

*Acting Commissioner of Patents and Trademarks*